US005946910A

United States Patent [19]

Hayashi et al.

[11] Patent Number: 5,946,910

[45] Date of Patent: Sep. 7, 1999

[54] HYDRAULIC CIRCUIT FOR HYDRAULICALLY DRIVEN WORKING VEHICLE

[75] Inventors: Seita Hayashi; Sadao Nunotani, both of Oyama, Japan

[73] Assignee: Komatsu Ltd., Tokyo, Japan

[21] Appl. No.: 08/952,267

[22] PCT Filed: May 15, 1996

[86] PCT No.: PCT/JP96/01282

§ 371 Date: Nov. 14, 1997

§ 102(e) Date: Nov. 14, 1997

[87] PCT Pub. No.: WO96/36776

PCT Pub. Date: Nov. 21, 1996

[30] Foreign Application Priority Data

May 17, 1995 [JP] Japan ..... 7-118312

[51] Int. Cl.[6] ..... F16D 31/02

[52] U.S. Cl. ..... 60/421; 60/426; 60/427; 60/429; 91/517

[58] Field of Search ..... 60/420, 421, 426, 60/422, 428, 429, 427; 91/517, 519

[56] References Cited

U.S. PATENT DOCUMENTS

| | | | |
|---|---|---|---|
| 3,800,669 | 4/1974 | Distler | 60/421 X |
| 3,916,625 | 11/1975 | Holtkamp | 60/421 |
| 5,211,014 | 5/1993 | Kropp | 60/421 |
| 5,692,377 | 12/1997 | Moriya et al. | 60/421 |

FOREIGN PATENT DOCUMENTS

| | | |
|---|---|---|
| 57-208349 | 12/1982 | Japan . |
| 62-206126 | 9/1987 | Japan . |
| 4-19406 | 1/1992 | Japan . |
| 5-106245 | 4/1993 | Japan . |
| 6-101249 | 4/1994 | Japan . |
| 6-123302 | 5/1994 | Japan . |

*Primary Examiner*—Hoang Nguyen
*Attorney, Agent, or Firm*—Sidley & Austin

[57] ABSTRACT

The present invention relates to a hydraulic circuit for a hydraulically driven working vehicle which allows the vehicle to travel at an almost constant speed during high-speed traveling, provides a great digging force during working, does not need a charging pressure for preventing cavitation, loses a small amount of energy, and has a simple structure. To this end, the hydraulic circuit has a hydraulic travel pump (2) and a working machine hydraulic pump (4) which are driven by the power of an engine (1) for discharging pressurized oil to a HST travel circuit and a working machine-driving hydraulic circuit, respectively, wherein pressurized oil from the working machine hydraulic pump (4) joins pressurized oil from the hydraulic travel pump (2) to effect high-speed traveling, while pressurized oil from the hydraulic travel pump (2) joins pressurized oil in the working machine hydraulic pump (4) to generate a large digging force to effect digging.

4 Claims, 15 Drawing Sheets

HYDRAULIC CIRCUIT FOR HYDRAULICALLY DRIVEN WORKING VEHICLE

TECHNICAL FIELD

The present invention relates to a hydraulic circuit for a hydraulically driven working vehicle, and more particularly, to a hydraulic circuit for a hydraulically driven vehicle, which travels via drive wheels which are driven by a hydraulic motor which is driven by hydraulic pumps which are driven by an engine, and which has a working machine attached thereto.

BACKGROUND ART

Hydraulically driven working vehicles have been known in which a hydraulic travel pump and a working machine hydraulic pump are driven by an engine, a travel motor is rotated by pressurized oil, discharged from the hydraulic travel pump to drive a drive wheel for traveling, and a working machine cylinder is extended and contracted by pressurized oil, discharged from the working machine hydraulic pump, to actuate a working machine. As a hydraulic circuit for the above-described hydraulically driven working vehicles, a hydraulic circuit disclosed in, for example, Japanese Unexamined Patent Publication No. 57-208349 has been known. In the hydraulic circuit, a hydraulic travel pump and a hydraulic travel motor are subjected to a closed-circuit connection by first and second main circuits, and the capacity of the hydraulic travel pump (hereinafter, the capacity shows a discharge amount per one rotation, cc/rev) is changed to determine a traveling speed. At this time, pressurized oil, discharged from the working machine hydraulic pump, is supplied to a working machine cylinder by a working machine valve, and when the working machine valve is placed in its neutral position, the discharged oil is supplied to one of the first and the second main circuits. In this hydraulic circuit, the pressurized oil, discharged from the working machine hydraulic pump, is supplied to the hydraulic travel motor, and the hydraulic travel motor rotates at a speed which is higher than the rotational speed corresponding to a maximum discharge amount of the hydraulic travel pump, thereby traveling the vehicle at a high speed.

However, this hydraulic circuit requires a first directional control valve, for supplying the discharged oil to one of the first and second main circuits; a manually-operated second directional control valve; and a third directional control valve, which is placed in a drain position when pressurized oil to be supplied increases to a set pressure or higher. In addition, this hydraulic circuit requires a complicated mechanism for switching the first directional control valve, by transmitting a movement of an operation member for changing the discharge direction of the hydraulic travel pump to the control valve, and a mechanism for switching the second directional control valve; whereby the structure of the circuit becomes very complicated. Incidentally, the third directional control valve prevents the pressurized oil, discharged from the working machine hydraulic pump, from being supplied to the first and second main circuits when the pressure of the first main circuit or the second main circuit is the set pressure or higher, i.e., when a traveling resistance is high and the hydraulic travel motor rotates at a low speed. In addition, in this hydraulic circuit, if the working valve is changed from its neutral position to an operating position when the traveling resistance is low and the hydraulic travel motor is rotating at a high speed, the working machine hydraulic pump actuates the working machine, so that the hydraulic travel motor is not supported by the working machine hydraulic pump, and a constant traveling speed cannot be obtained. For this reason, it is dangerous for an operator to actuate the working machine while traveling, because the speed suddenly changes.

In addition, for example, when earth and sand are loaded on a bucket by a loader, and the loader approaches a dump truck at a slow speed, a problem arises in that the rotational speed of the hydraulic travel motor increases because the motor is supported by the working machine hydraulic pump, so that it becomes difficult for the operator to control the loader so as to approach the dump truck at a low speed.

In addition, when digging resistance is high during digging with the working machine, the working machine can stop. Then, one of the following operations is required: the working machine is operated to decrease the digging resistance; the vehicle is moved forwardly by imparting a load to the hydraulic travel motor; or the vehicle is moved backwardly. This creates a problem in that the operations required by the operator increase and cause fatigue, and the amount of work performed decreases.

Further, since the closed circuit is used, it becomes necessary to supply a constant amount of oil to the first main circuit or the second main circuit in order to prevent cavitation, and a problem arises in that energy is lost.

As an another embodiment, Japanese Unexamined Patent Publication No. 5-106245 has been known. According to the Official Gazette, a self-propelled working vehicle having an HST hydraulic travel device includes a variable displacement hydraulic pump, and a variable displacement hydraulic travel motor which is subjected to a closed circuit connection to the pump by a pair of main pipes, and obtains a traveling force using the output torque of the hydraulic motor. The self-propelled working vehicle decreases the discharge capacity of the variable displacement hydraulic motor until the detected operation speed of a front working machine reaches a predetermined value at least when the detected driving pressure of the front working machine hydraulic cylinder is a predetermined value or higher. Therefore, the traveling torque is reduced when a large front driving force is required; and a lifting force, which is larger by the amount of the reduction of the traveling torque, can be obtained so that the front working machine positively starts operation in any type of earth and sand.

However, although it is described that when the digging resistance is high during digging with the working machine, the discharge capacity of the hydraulic travel motor is reduced to decrease the traveling tractive force, and the decreased engine output is used to increase the lifting force oil pressure for increasing the lifting force, the lifting force of the working machine is not increased, so that the force available for crushing a rock bed becomes weaker by the amount of the reduction of the traveling tractive force, and the digging force cannot be increased.

In addition, since the closed circuit is used, it becomes necessary to supply a constant amount of oil to the closed circuit in order to prevent cavitation, and a problem arises in that energy is lost.

SUMMARY OF THE INVENTION

The present invention pays attention to the problems of the prior art, and relates to a hydraulic circuit for a hydraulically driven working vehicle, and its object is to provide a hydraulic circuit which allows the vehicle to travel at an almost constant speed during high-speed traveling, provides a great digging force during working, does not need charging pressure for preventing cavitation, loses a small amount of energy, and has a simple structure, particularly for a hydraulically driven working vehicle which travels by driving drive wheels via a hydraulic motor and hydraulic pumps driven by an engine, and to which a working machine is attached.

In a first aspect according to the present invention, there is provided a hydraulic circuit for a hydraulically driven working vehicle, comprising: a HST travel circuit, driven by the power of an engine to travel the vehicle; a working machine-driving hydraulic circuit, driven by the power of the engine to drive a working machine, such as a bucket, attached to the vehicle; a hydraulic travel pump and a working machine-driving hydraulic pump for discharging pressurized oil for the HST travel circuit and for discharging pressurized oil for the working machine-driving hydraulic circuit, respectively; and a flow joining/dividing valve for joining or dividing oil discharged from the hydraulic travel pump and the working machine-driving hydraulic pump with oil discharged in another circuit or into its own circuit, wherein oil discharged from the working machine-driving hydraulic pump joins discharged oil in the HST travel circuit when the pressure of the HST travel circuit is lower than a first predetermined pressure and the engine speed is a predetermined value or higher, and the joining of the oil discharged from the working machine-driving hydraulic pump is cut off when the pressure of the HST travel circuit is higher than the first predetermined pressure.

In addition, the hydraulic circuit is preferably a HST travel circuit in the form of an open circuit comprising: a tank, for storing oil; a variable displacement hydraulic travel pump, for sucking oil and for discharging pressurized oil; a travel directional control valve, for switching the pressurized oil from the variable displacement hydraulic travel pump; and a hydraulic travel motor, rotating clockwise or counterclockwise to produce an output upon receipt of the switched pressurized oil from the traveling directional control valve. Further, the joining is preferably selected in operative association with a selector switch for switching between high-speed traveling and low-speed traveling.

By the described arrangements, the second directional control valve is placed in its communication position when the load of the hydraulic travel motor is low and the pressure of the hydraulic travel pump is low, and the first directional control valve is placed in its support position when the engine rotates at a high speed and the pressure of the pressure generating means is the switched pressure or higher, so that pressurized oil, discharged from the working machine hydraulic pump is supplied to the hydraulic travel motor when traveling at a high engine speed and a low load, thereby increasing the speed. At this time, even if the working machine valve is operated, since the discharge pressure of the working machine hydraulic pump is shut off by the first directional control valve, the discharge pressure of the working machine hydraulic pump is always supplied to the hydraulic travel motor, and the vehicle runs at a constant speed, so that the operator can drive with safety. In addition, since the first directional control valve and the second directional control valve, for controlling the support from the working machine hydraulic pump to the travel circuit, are automatically switched by pressure, a complicated connecting mechanism is not required, so that the structure is simplified. Incidentally, at this time, the operation of the working machine can be performed by using oil pressure of other circuits (for example, steering, etc.) and by operating the working machine valve, so that the working machine can be raised and lowered even during high speed traveling. In addition, since the open circuit is used, the driving of a charge pump for preventing cavitation is not required, and the energy loss is reduced. Further, when the frequency of working while traveling is high, or when digging a hard rock bed, etc., the working can be performed at a low speed while outputting a high digging force and tractive force by selecting a low-speed traveling and working mode via the Low position of the Hi/Low switch. For example, when loading heavy and hard rocks, etc., on a loader and approaching a dump truck at a slow speed, the rotational speed of the hydraulic travel motor decreases because it is not supported by the working machine hydraulic pump, so that the operator can easily bring the loader near the dump truck at a slow speed. In addition, when digging soft soil, earth, sand, etc., the sand, etc., can be transported by high-speed traveling after digging by selecting a high-speed traveling mode via the Hi position of the Hi/Low switch, so that the work cycle is improved and the amount of work performed increases.

In a second aspect according to the present invention, there is provided a hydraulic circuit for a hydraulically driven working vehicle, comprising: a HST travel circuit, driven by the power of an engine to travel the vehicle; a working machine-driving hydraulic circuit, driven by the power of the engine to drive a working machine, such as a bucket, which is attached to the vehicle, and having a controlled pressure which is lower than that of the HST travel circuit; a hydraulic travel pump and a working machine-driving hydraulic pump, for discharging pressurized oil to the HST travel circuit and for discharging pressurized oil to the working machine-driving hydraulic circuit, respectively; and a flow joining/dividing valve, for joining or dividing oil discharged from the hydraulic travel pump and the working machine-driving hydraulic pump with discharged oil in another circuit or into its own circuit, wherein pressure of the HST travel circuit is compared with the pressure of the working machine-driving hydraulic circuit, and pressurized oil from the HST travel circuit joins pressurized oil in the working machine-driving hydraulic circuit when the pressure of the HST travel circuit is higher than the pressure of the working machine-driving hydraulic circuit, or higher than the controlled pressure of the working machine-driving hydraulic circuit. In addition, the pressure of the working machine-driving hydraulic circuit is preferably reduced when pressurized oil from the HST travel circuit joins pressurized oil in the working machine-driving hydraulic circuit. Further, the pressure of the pressurized oil from the HST travel circuit which joins the pressurized oil in the working machine-driving hydraulic circuit is preferably the controlled pressure or higher, and an allowable pressure or lower of the working machine-driving hydraulic circuit. Still further, the hydraulic circuit is preferably a HST travel circuit in the form of an open circuit comprising: a tank for storing oil; a variable displacement hydraulic travel pump for sucking oil and for discharging pressurized oil; a travel directional control valve, for switching the pressurized oil from the variable displacement hydraulic travel pump; and a hydraulic travel motor, rotating clockwise or counterclockwise to produce an output upon receipt of the switched pressurized oil from the travel directional control valve. In addition, the joining is preferably selected in operative association with a selector switch for switching between high-speed traveling and low-speed traveling.

By the described arrangements, since the controlled pressure of the HST travel circuit is set higher than the controlled pressure of the working machine-driving hydraulic circuit, the pressure of the pressurized oil from the HST travel circuit is joined with the pressure of the pressurized oil in the working machine-driving hydraulic circuit when the pressure of the HST travel circuit is higher than the pressure of the working machine-driving hydraulic circuit, or higher than the controlled pressure of the working machine-driving hydraulic circuit, so that digging can be effected by the high operational pressure of the HST travel circuit even if the pressure of the working machine-driving hydraulic circuit is the controlled pressure. For this reason, a digging force of the working cylinder is increased, thereby increasing the amount of work performed by the working machine. At this time, if the operator increases the pressure of the HST travel circuit to increase a traveling tractive force, the digging force of the working cylinder is increased by the further increased pressure, and the digging can be effected by the traveling tractive force while pushing, so that harder rock bed, etc., can easily be crushed, and workability is further improved. In addition, at this time, the engine can decrease the load exerted thereon by reducing the pressure of the working machine-driving hydraulic circuit. The output of the engine can be used for a lifting force, or a traveling tractive force of the working machine under the pressure of the HST travel circuit, so that the output of the engine can be efficiently used for the working machine. In addition, the pressure of the discharged oil from the HST travel circuit to be joined with the discharged oil in the working machine-driving hydraulic circuit is set to the allowable pressure, or lower, of the hydraulic equipment used for the working machine-driving hydraulic circuit, so that the durability of the hydraulic equipment is ensured. Therefore, an inexpensive fixed gear pump having a low allowable pressure can be used in the working machine-driving hydraulic circuit; and a swash plate control is not required; whereby the hydraulic circuit is simplified and can be provided at low cost. In addition, since the open circuit is used, the driving of a charge pump for preventing cavitation is not required, and the energy loss is reduced. Further, when the frequency of working while traveling is high, or when digging a hard rock bed, etc., the working can be performed at a low speed while outputting a high digging force and tractive force by selecting low-speed traveling and working mode via the Low position of the Hi/Low switch. For example, when loading heavy and hard rock, etc., on a loader and approaching a dump truck at a slow speed, the rotational speed of the hydraulic travel motor decreases because it is not supported by the working machine hydraulic pump, so that the operator can easily bring the loader near the dump truck at a slow speed. In addition, when digging soft soil, earth, sand, etc., the sand, etc., can be transported by a high-speed traveling after digging, by selecting a traveling mode via the Hi position of the Hi/Low switch, so that the work cycle is improved and the amount of work performed increases.

In a third aspect according to the present invention, there is provided a hydraulic circuit for a hydraulically driven working vehicle, comprising: an HST travel circuit, having a variable displacement hydraulic travel pump, a travel directional control valve, and a hydraulic travel motor; a working machine-driving hydraulic circuit having a working machine-driving hydraulic pump, a working machine-driving directional control valve, and a working machine-driving actuator; a flow-joining valve for opening and closing a joining circuit for joining pressurized oil from the HST travel circuit with the pressurized oil in the working machine-driving hydraulic circuit; and a control means, for outputting a switching signal to the flow-joining valve; wherein the joining circuit comprises: a flow-joining valve, provided on a support circuit which is connected downstream of check valves, one of which is disposed in the HST travel circuit, and the other one of which is disposed between the working machine driving hydraulic pump and the working machine-driving directional control valve; and a control means, for outputting a command to the flow-joining valve to open when the pressure of the working machine-driving hydraulic circuit is a predetermined pressure value or higher. In addition, the control means may preferably output a command to the flow-joining valve to close at a second predetermined pressure value or higher. Or, the control means may preferably be any one of a signal from a selector switch, a signal from a pressure-proportional control valve for switching the working machine-driving directional control valve, and a signal from the pressure sensor and the selector switch of the working machine driving hydraulic circuit.

In addition, the hydraulic circuit for the vehicle may preferably include an unload valve, which is arranged on a circuit divided between the flow-joining valve and the working machine-driving directional control valve, and which is switched upon receipt of pilot pressure from the working machine driving hydraulic circuit or a signal from the control means for controlling the joining. Further, the flow-joining valve may preferably include a first flow-joining valve for joining pressurized oil from the HST travel circuit with pressurized oil in the working machine-driving hydraulic circuit, and a second flow-joining valve for joining pressurized oil from the working machine-driving hydraulic circuit with pressurized oil in the HST travel circuit, which are provided in a one-piece valve body. Still further, the hydraulic circuit for the vehicle may preferably be a HST travel circuit in the form of an open circuit comprising: a tank for storing oil; a variable displacement hydraulic travel pump, for sucking oil and for discharging pressurized oil; a travel directional control valve, for switching the pressurized oil from the variable displacement hydraulic travel pump; and a hydraulic travel motor, rotating clockwise or counterclockwise to produce an output upon receipt of the switched pressurized oil from the traveling directional control valve. In addition, the joining may preferably be selected in operative association with a selector switch for switching between high-speed traveling and low-speed traveling.

By the described arrangements, the supply circuit, for joining the pressurized oil from the HST travel circuit with the pressurized oil in the working machine-driving hydraulic circuit, is connected downstream of the check valves, one of which is disposed in the HST travel circuit, and the other one of which is disposed between the working machine-driving hydraulic pump and the working machine-driving directional control valve; and the flow-joining valve, which opens when the pressure of the working machine driving hydraulic circuit is a predetermined pressure value or higher, is provided therebetween, so that the structure of the hydraulic circuit is simplified. The high pressure of the HST travel circuit does not act on the working machine-driving hydraulic pump due to the check valves, so that an inexpensive fixed gear pump of a simple structure can be used in the working machine-driving hydraulic circuit; and a control circuit is not required, whereby the structure of the hydraulic circuit is simplified. In addition, a lower limit value and an upper limit value of the pressure are provided for the flow-joining valve for joining pressurized oil from the HST travel circuit with the pressurized oil in the working machine driving hydraulic circuit, so that a back flow from the working machine-driving hydraulic circuit to the HST travel circuit can be prevented at the lower limit value, and the pressure of the working machine-driving hydraulic circuit can be held within an allowable range of the hydraulic equipment. The operation of the flow-joining valve can be automatically switched by the pressure of the HST travel circuit or of the working machine-driving hydraulic circuit, so that the operability for the operator is improved. Or, the operation can be switched by the selector switch, attached to the operating lever of the working machine-driving hydraulic circuit, so that the operator can easily switch the operation. Since the pressure of the working machine-driving hydraulic circuit is automatically unloaded when reaching a predetermined pressure, the load exerted on the engine can be decreased similar to the above description, and the output of the engine can be used for a lifting force, or a traveling tractive force of the working machine under the pressure of the HST travel circuit, so that the output of the engine can be efficiently used for the working machine. The flow-joining valve includes a first flow-joining valve, for joining pressurized oil from the HST travel circuit with pressurized oil in the working machine-driving hydraulic circuit, and a second flow-joining valve, for joining pressurized oil from the working machine-driving hydraulic circuit with pressurized oil in the HST travel circuit, which are provided in a one-piece valve body, so that the structure is simplified. Further, since the unload valve is also provided in the one-piece valve body, the overall structure is further simplified, a space area can be reduced, and pipes for connecting respective devices are not required. In addition, since the open circuit is used, the driving of a charge pump for preventing cavitation is not required, and the energy loss is reduced. Further, when the frequency of working while traveling is high, or when digging a hard rock bed, etc., the working can be performed at a low speed while outputting a high digging force and tractive force by selecting a low-speed traveling and working mode via the Low position of the Hi/Low switch. For example, when loading heavy and hard rock, etc., on a loader and approaching a dump truck at a slow speed, the rotational speed of the hydraulic travel motor decreases because it is not supported by the working machine hydraulic pump, so that the operator can easily bring the loader near the dump truck at a slow speed. In addition, when digging soft soil, earth, sand, etc., the sand, etc., can be transported by a high-speed traveling after digging by selecting a traveling mode via the Hi position of the Hi/Low switch, so that the work cycle is improved and the amount of work performed increases.

BEST MODE FOR CARRYING OUT THE INVENTION

The preferred embodiments of a hydraulic circuit for a hydraulically driven working vehicle according to the present invention will be described in detail with reference to the attached drawings.

Figure 1:
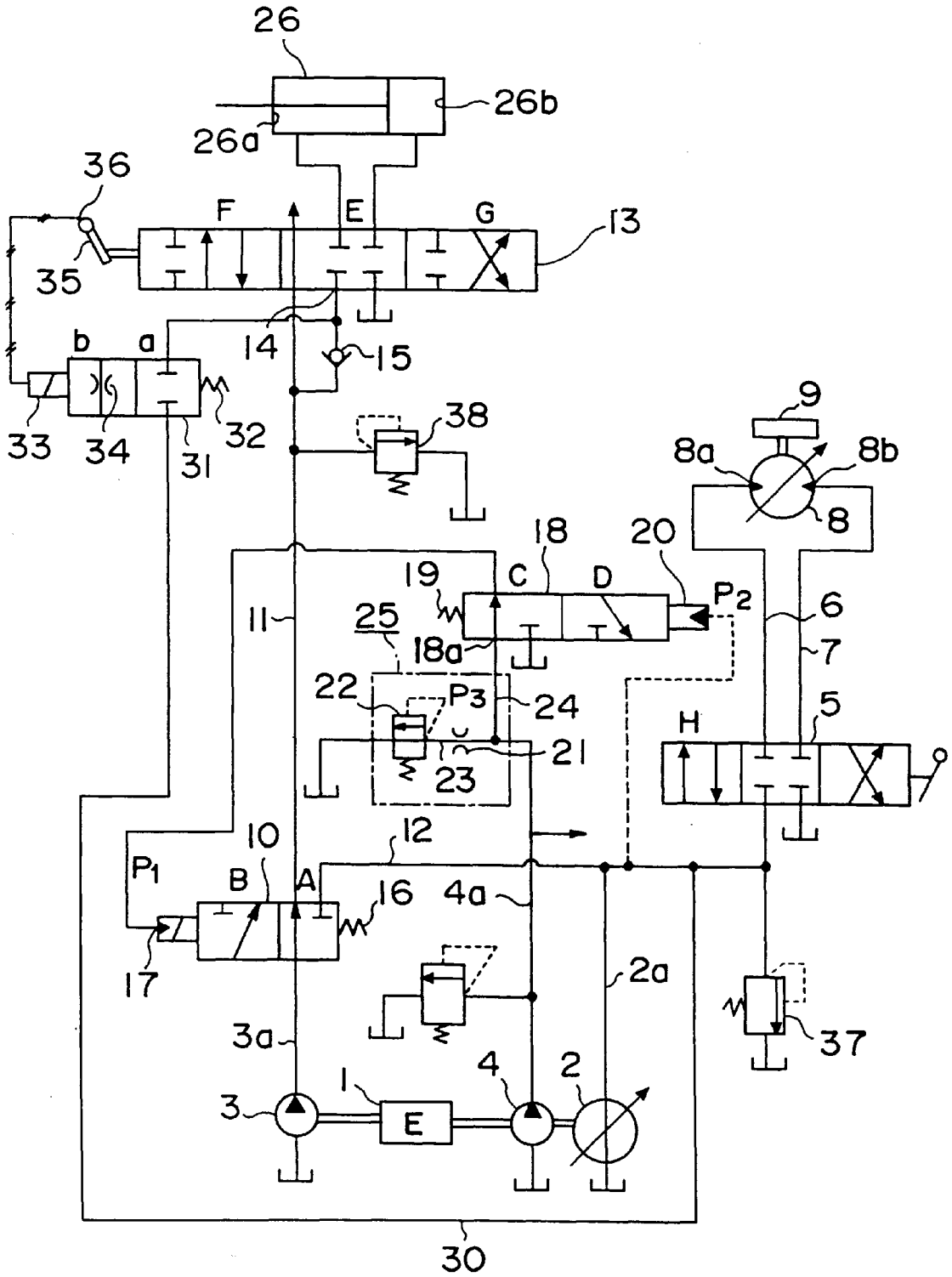
FIG. 1 is a hydraulic circuit diagram showing a first embodiment of a hydraulically driven working vehicle according to the present invention.

FIG. 1 is a hydraulic circuit diagram of a first embodiment of the present invention. As shown in FIG. 1, a hydraulic travel pump 2; a working machine-driving hydraulic pump 3, for driving a working machine (hereinafter, referred to as a working machine hydraulic pump 3); and a controlling hydraulic pump 4 are driven by an engine 1. A discharge path 2*a* of the hydraulic travel pump 2, for a HST travel circuit, is connected to one of a first main circuit 6 and a second main circuit 7 by switching a traveling valve 5, and the first and second main circuits 6 and 7 are connected to a normal rotation port 8*a* and a reverse rotation port 8*b* of a hydraulic travel motor 8, respectively. An output torque of the hydraulic travel motor 8, which is connected to the first main circuit 6 and the second main circuit 7, drives a drive wheel 9.

A discharge path 3*a*, of the working machine hydraulic pump 3 of a working machine-driving hydraulic circuit, is controlled by a first directional control valve 10 of a flow joining/dividing valve for joining with another circuit or discharging into its own circuit, so as to be connected to either one of a working machine circuit 11 and a support circuit 12. The working machine circuit 11 is connected to a pump port 14 of a working machine valve 13 through a load check valve 15, and the support circuit 12 is connected to the discharge path 2*a* of the hydraulic travel pump 2.

The first directional control valve 10 is held in its first position A by a spring 16, and is placed in its second position B when a pressure of a prescribed switching pressure valve P1 or higher is applied to a pressure receiving portion 17, and a pressure proportional to the engine speed is supplied to the pressure receiving portion 17 by a second directional control valve 18. The second directional control valve 18 is held in its supply position C by a spring 19, and is placed in its drain position D when a pressure of a set first switching pressure valve P2 (hereinafter, referred to as first switching pressure P2) or higher is supplied to a pressure receiving portion 20.

A restrictor 21 and a drain circuit 23, including a low-pressure relief valve 22, are connected to a discharge path 4*a* of the controlling hydraulic pump 4, and a detection circuit 24 branches from the upstream end of the restrictor 21, thereby constituting a pressure generation means 25 for generating a pressure proportional to the engine speed. The detection circuit 24 is connected to an inlet port 18*a* of the second directional control valve 18. In other words, the upstream pressure P3 of the restrictor 21 is proportional to the square of a flow rate passing through the restrictor 21, the passing flow rate of the restrictor 21 is proportional to a discharge flow rate of the controlling hydraulic pump 4, and the discharge flow rate is proportional to the speed of the engine 1, so that the upstream pressure P3 of the restrictor 21 is proportional to the square of the speed of the engine 1.

The working machine valve 13 connects the working machine circuit 11 to another valve or tank when placed in its neutral position E, supplies pressurized oil to the contraction chamber 26*a* of the working machine cylinder 26 when placed in its first position F, and supplies pressurized oil to the extension chamber 26*b* of the working machine cylinder 26 when placed in its second position G. A supply circuit 30 is connected to the discharge path 2*a* of the hydraulic travel pump 2; the supply circuit 30 is connected between the pump port 14 and the load check valve 15 of the working machine hydraulic valve 13; and the supply circuit 30 is provided with an open/close valve 31.

The open/close valve 31 is placed in its shutoff position a by a spring 32, and in its communication position b, having a restrictor 34, when energized by a solenoid 33; and the solenoid 33 is energized by external operating members. For example, when the open/close valve 31 is connected to a power-supply circuit through a switch 36, provided on an operating lever 35 of the working machine valve 13, and the switch 36 is turned ON (enter), the solenoid 33 is energized.

Next, a traveling operation will be described. In normal operations, the working machine valve 13 is placed in its neutral position E; the travel valve 5 is placed in its forward position H; pressurized oil, discharged from the hydraulic travel pump 2, is supplied to the normal rotation port 8*a* of the travel motor 8; and the drive wheel 9 is driven in a normal rotational direction to allow the vehicle to effect forward traveling. In addition, backward traveling can be effected by operating the travel valve 5 in the direction opposite to its forward position H, and by supplying the discharged pressurized oil, discharged by the hydraulic travel pump 2, to the reverse rotation port 8*b* of the travel motor 8 to rotate the travel motor 8 in the reverse direction.

When the traveling resistance of the drive wheel 9 is low under the above-described condition, the load of the hydraulic travel motor 8 is reduced, and the pump pressure of the hydraulic travel pump 2 becomes a low pressure in accordance therewith. The low pump pressure acts on the pressure receiving portion 20 of the second directional control valve 18 as the pressure of the first switching pressure P or lower, and the second directional control valve 18 is placed in its supply position C. This allows the upstream pressure P3 of the restrictor 21 to be supplied to the pressure receiving portion 17 of the first directional control valve 10 by way of the supply position C of the second directional control valve 18.

When an operator increases the speed of the engine 1 to high speed under the above-described condition, the discharge flow rate of the hydraulic travel pump 2 increases, the hydraulic travel motor 8 rotates at a high speed, and the drive wheel 9 is driven at a high speed, so that the vehicle travels at a high speed and a low load. The vehicle speed at this time increases with an increase in the speed of the engine 1.

The discharge flow rate of the controlling hydraulic pump 4 increases with an increase in the speed of the engine 1. When the speed of the engine 1 increases to a predetermined speed or higher, the upstream pressure P3 of the restrictor 21 is increased, to the switching pressure P1 or higher of the first directional control valve 10, by the increased discharge flow rate of the controlling hydraulic pump 4. By the pressure of the switching pressure P1 or higher, the first directional control valve 10 is placed in its second position B, the pressurized oil, discharged from the working machine hydraulic pump 3, is supplied from the support circuit 12 to the normal rotation port 8*a* of the hydraulic travel motor 8 by way of the discharge path 2*a*, the travel valve 5, and the first main circuit 6; and the hydraulic travel motor 8 rotates at a higher speed to increase the vehicle speed. In this way, when the traveling resistance of the hydraulic travel motor 8 is low (driving pressure is low) on a level ground, the engine 1 rotates at a high speed, and the vehicle travels at a high speed, the pressurized oil, discharged from the working machine hydraulic pump 3, is supplied to the hydraulic travel motor 8 without becoming a resistance, unlike a conventional manner, so that the engine output can effectively be used.

When the traveling resistance of the drive wheel 9 increases under the above-described condition, the load of the hydraulic travel motor 8 also increases, so that the pressure acting on the hydraulic travel pump 2 becomes a high pressure. This allows the pressure acting on the pressure receiving portion 20 of the second directional control valve 18 to increase to the first switching pressure P2 or higher, and the second directional control valve 18 is switched to its drain position D. Since, in the drain position D, the pressure receiving portion 17 of the first directional control valve 10 communicates with a tank, the first directional control valve 10 is placed in its first position A, so that the pressurized oil, discharged from the working machine hydraulic pump 3, flows into the tank via the working machine valve 13. At this time, by setting the resistance of the circuit to low, the discharge pressure of the working machine hydraulic pump 3 becomes a low pressure, and at the same time the input torque reduces to substantially zero, so that the output of the engine 1 can effectively be used as the input torque of the hydraulic travel pump 2. In addition, even if the engine 1 rotates at a high speed, the first directional control valve 10 is automatically switched when a load acts on the working machine and a load of a predetermined value or higher acts on the hydraulic travel motor 8, so that the pressurized oil, discharged from the working machine hydraulic pump 3, flows into the working machine valve 13. This enables an operation, such as digging.

As described above, since the pressurized oil, discharged from the working machine hydraulic pump 3, is supplied to the hydraulic travel motor 8 when traveling with a high speed of the engine 1 and a low load of the hydraulic travel motor 8 (when traveling at a high speed and a low load), the speed can be increased higher than a traveling speed corresponding to the maximum discharge amount of the hydraulic travel pump 2. In short, the discharge amount (the discharge amount per unit time) of the hydraulic travel pump 2 is determined by the engine speed, and becomes maximum during high-speed rotation. Incidentally, even if the hydraulic travel pump 2 is of a variable displacement type, the discharge amount is determined by the engine speed x capacity (the discharge amount per one rotation), and becomes maximum during high-speed rotation because the capacity is usually set to the maximum when the discharge pressure is low.

Incidentally, when the hydraulic travel pump 2 is of the variable displacement type and the horsepower is controlled to be constant, the capacity is increased or decreased by the pump pressure to control the input torque (capacity x engine speed x pump pressure) to be constant, so that the capacity per one rotation increases and the discharge amount becomes maximum during a low load as described above.

Thus, when the engine 1 rotates at a high speed and the load is low, the discharge amount (discharge amount per unit time) of the hydraulic pump 2 becomes maximum and the traveling speed also becomes maximum. Further, according to the present invention, the pressurized oil discharged from the working machine hydraulic pump 3, is supplied at this time to further increase the speed.

In addition, when traveling with a low speed rotation of the engine 1 and a low load of the hydraulic travel motor 8, the pressure acting on the pressure receiving portion 17 of the first directional control valve 10 decreases to the switching pressure P1 or lower, and the first directional control valve 10 is placed in its first position A, so that by placing the working machine valve 13 in its first position F, or its second position G, the pressurized oil can be supplied to the contraction chamber 26*a* or the extension chamber 26*b* of the working machine cylinder 26 to operate the working machine. This allows the working machine to be operated during traveling at a low speed. Thus, when the hydraulically driven working vehicle is a wheel loader, the vehicle can travel at a low speed to perform a crane operation while suspending a load by a bucket. In addition, when loading a load on a dump truck, the bucket can be raised while traveling at a low speed and the vehicle can approach the dump truck while traveling at a slow speed, so that operability is improved and the operation is facilitated, whereby a cycle time of the loading operation, etc., can be shortened.

In addition, since the pressurized oil, discharged from the working machine hydraulic pump 3, is supplied from the inlet side of the working machine valve 13 to the hydraulic travel motor 8, even if the working machine valve 13 is placed in its first or second position F or G, the pressurized oil, discharged from the working machine hydraulic pump 3, can be supplied to the hydraulic travel motor 8 at once when traveling with the high-speed rotation of the engine and the low load, whereby the traveling speed can be increased. For example, when the engine is rotated at a high speed by an accelerator, etc., during the above-described crane operation, the load suspension can be stopped to increase the traveling speed without operating the working machine valve 13, and the original operation can be continued when the traveling speed is decelerated.

Next, a digging operation will be described. When the hydraulically driven working vehicle is a wheel loader, an operator switches the travel valve 5 to its forward position H to effect the forward traveling of the vehicle as described above, and digs a non-illustrated bucket into the natural ground. When the bucket is dug into the natural ground, the operator places the working machine valve 13 in its second position G to supply the discharge pressure of the working machine hydraulic pump 3 to the extension chamber 26*b* of the working machine cylinder 26, and raises the bucket to effect digging.

In short, when the bucket is dug into the natural ground, the traveling resistance of the drive wheel 9 increases and the pump pressure of the hydraulic travel pump 2 approaches the controlled pressure (for example, 420 kg/cm$^2$) of a travel relief valve 37. By this pressure, the second directional control valve 18 is placed in its drain position D, so that the first directional control valve 10 is placed in its first position A, regardless of the engine speed, whereby the pressurized oil, discharged from the working machine hydraulic pump 3, is supplied to the working machine circuit 11.

During the above-described digging operation, the pressure in the extension chamber 26*b* of the working machine cylinder 26 increases only up to the controlled pressure (for example, 210 kg/cm$^2$) of the working machine relief valve 38, so that the magnitude of thrust of the working machine cylinder 26 corresponds to the controlled pressure of the working machine relief valve 38. For this reason, a force for moving the bucket upwardly may be insufficient, so that the bucket cannot be raised. In this case, the operator turns on the switch 36, energizes the solenoid 33 to place the open/close valve 31 in its communication position b, supplies a high pump pressure of the hydraulic travel pump 2 to the extension chamber 26*b* of the working machine cylinder 26 to increase the thrust, and increases the raising force to raise the bucket.

Figure 2:
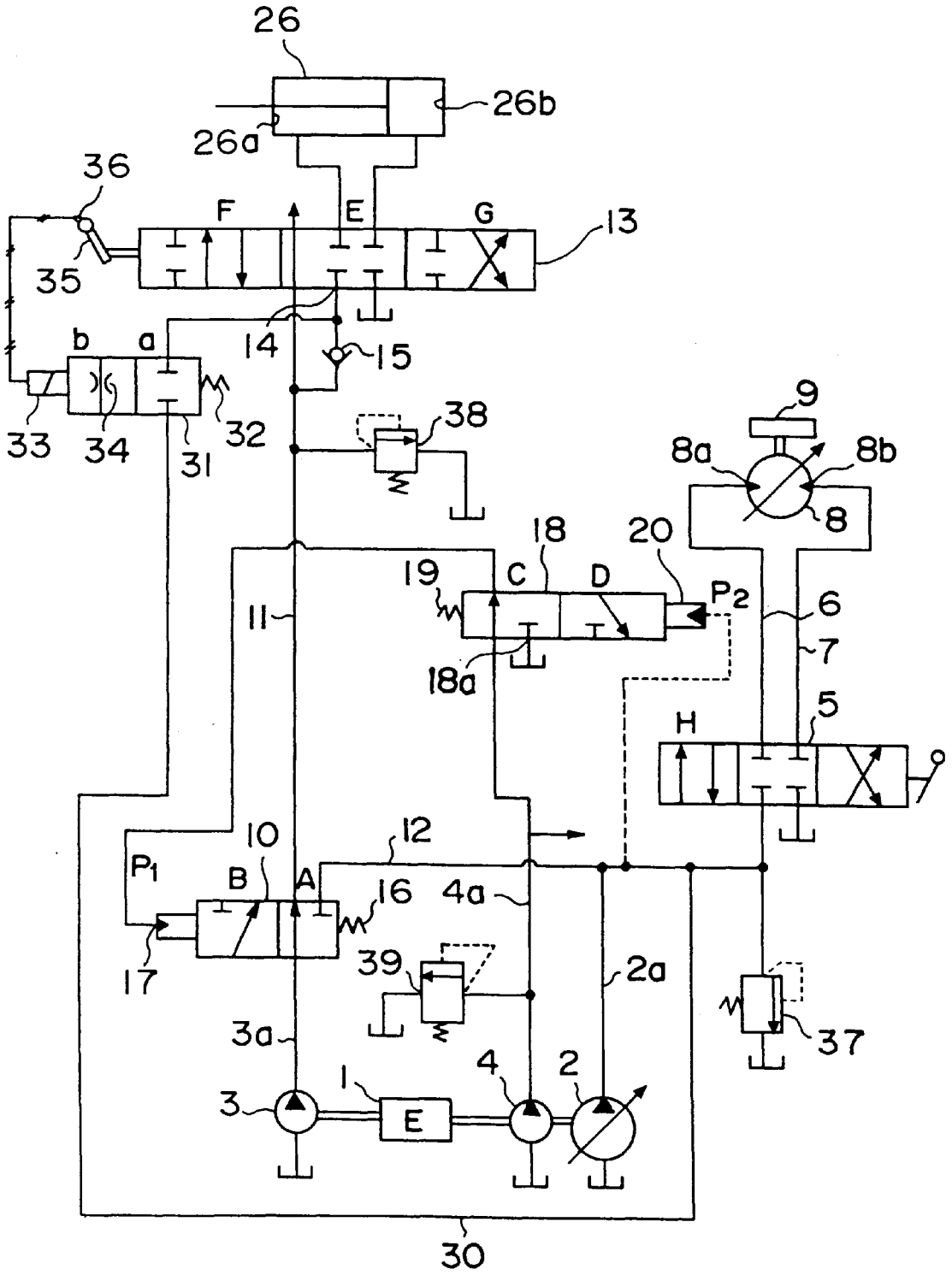
FIG. 2 is a hydraulic circuit diagram showing a second embodiment of a hydraulically driven working vehicle according to the present invention.

FIG. 2 shows a hydraulic circuit diagram of a second embodiment. In the second embodiment, the discharge path 4*a* of the controlling hydraulic pump 4 is connected to the inlet port 18*a* of the second directional control valve 18, and the switching pressure P1 of the first directional control valve 10 is the controlled pressure of a relief valve 39 provided on the discharge path 4*a* of the controlling hydraulic pump 4. This allows the pressurized oil, discharged from the working machine hydraulic pump 3 to be supplied to the hydraulic travel motor 8 during the low-load traveling regardless of the engine speed, whereby high-speed rotation can be effected.

Figure 3:
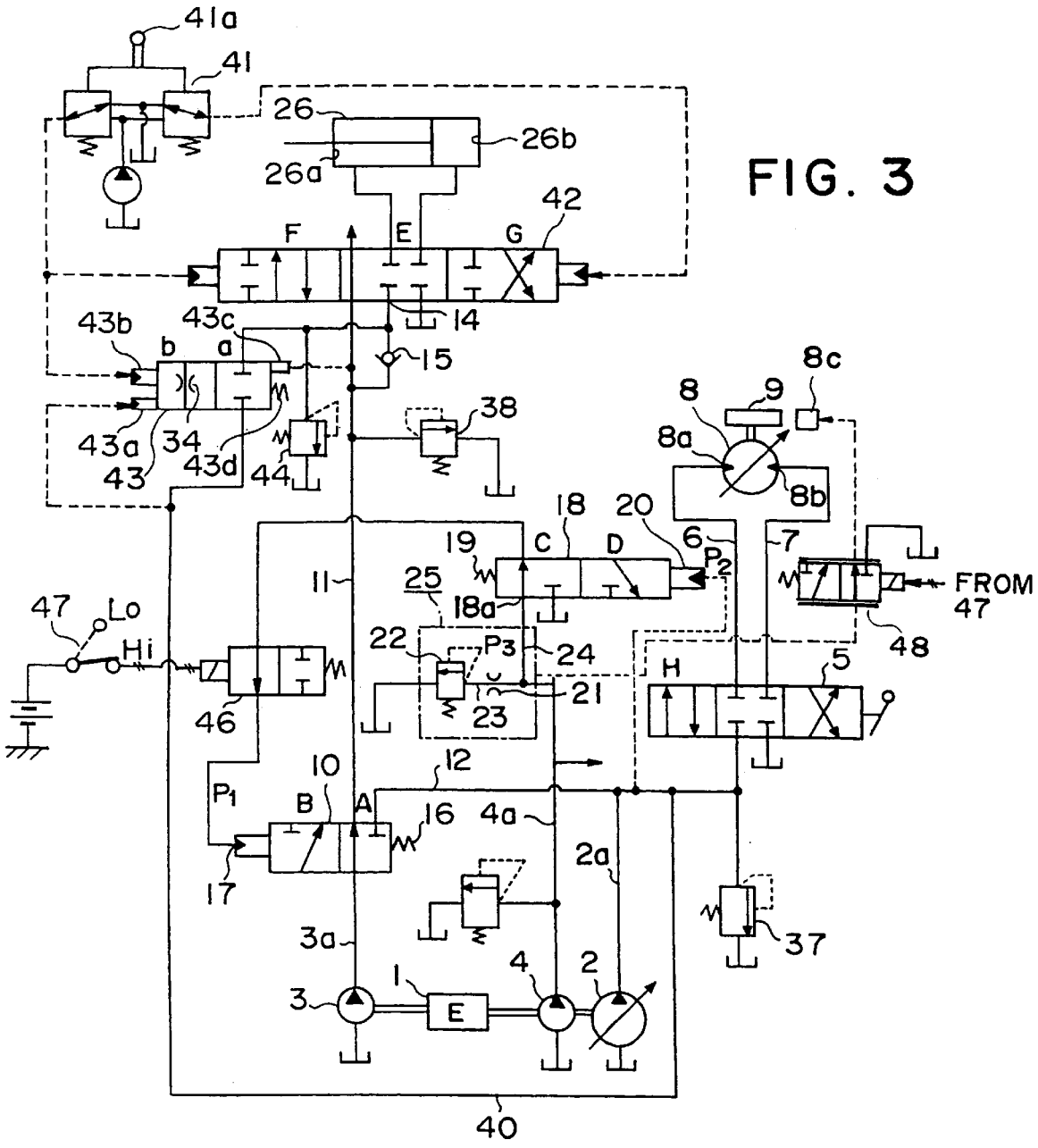
FIG. 3 is a hydraulic circuit diagram showing a third embodiment of a hydraulically driven working vehicle according to the present invention.

FIG. 3 is a hydraulic circuit diagram of a third embodiment. In the first embodiment, the electromagnetic open/close valve 31, actuated by the manually-operated working machine valve 13 and the solenoid 33, is used, and the supply circuit 30 from the hydraulic travel pump 2 is connected between the pump port 14 and the load check valve 15 of the working machine valve 13. In contrast, in the third embodiment, as shown in FIG. 3, pilot oil pressure from a pressure-proportional pressure reduction valve 41, linked to an operating lever 41*a*, controls a working machine hydraulic valve 42 and a hydraulic open/close valve 43; and a first supply circuit 40, from the hydraulic travel pump 2 is connected between the pump port 14 and the load check valve 15 of the working machine hydraulic valve 42, similar to the first embodiment. In addition, although the working machine relief valve 38 is disposed between the working machine valve 13 and the first directional control valve 10 in the first embodiment, another working machine circuit-allowing relief valve 44 is additionally disposed between the hydraulic open/close valve 43 and the working machine hydraulic valve 42 in the third embodiment.

A first pressure receiving portion 43*a*, for receiving the switching pressure from the first supply circuit 40, and a second pressure receiving portion 43*b*, for receiving the switching pressure from the pressure-proportional pressure reduction valve 41, are attached to one end of the hydraulic open/close valve 43; and a third pressure receiving portion 43*c*, for receiving the switching pressure from the working machine hydraulic pump 3, and a spring 43*d* are attached to the other end.

When the controlled pressure of the working machine relief valve 38 acts on the third pressure receiving portion 43*c* of the hydraulic open/close valve 43, pressurized oil from the hydraulic travel pump 2 increases to the controlled pressure (for example, 210 kg/cm$^2$), or higher, of the working machine relief valve 38 to act on the first pressure receiving portion 43*a*; and a one-step higher pilot pressure, from the pressure-proportional pressure reduction valve 41, acts on the second pressure receiving portion 43*b*, opposing the spring force of the spring 43*b* and switching valve 43 from its shutoff position a to its communication position b. The one-step higher pilot pressure, from the pressure-proportional pressure reduction valve 41, is generated when the operator fully operates the operating lever 41*a* up to the stroke end. In addition, even if the pressurized oil from the hydraulic travel pump 2 reaches the controlled pressure of 420 kg/cm$^2$ of the travel relief valve 37, the hydraulic open/close valve 43 is not switched from its shutoff position a to its communication position b, because the pressing force of the first pressure receiving portion 43*a* is set lower than the spring force of the spring 43*d*. In addition, even if the operating lever 41*a* is operated when the working machine relief valve 38 reaches the controlled pressure, the hydraulic open/close valve 43 is not switched from its shutoff position a to its communication position, due to the spring force of the spring 43*d* and the reactive force of the third pressure receiving portion 43*c*.

In the above-described arrangements, in order to simplify the apparatus, the first pressure receiving portion 43*a* and the third pressure receiving portion 43*c* may be omitted so that the hydraulic open/close valve 43 presses the spring force of the spring 43*d* so as to be changed from its shutoff position a to its communication position b when the operator fully operates the operating lever 41*a* and the one-step higher pilot pressure is generated from the pressure-proportional pressure reduction valve 41.

The working machine circuit-allowing relief valve 44 reduces and restricts the high pressure from the hydraulic travel pump 2 to the pressure allowed by the working machine hydraulic equipment. For example, in the case where the working vehicle is a wheel loader, the controlled pressure of the travel relief valve 37 is controlled to 420 kg/cm$^2$, the controlled pressure of the working machine relief valve 38 is controlled to 210 kg/cm$^2$, and the controlled pressure of the working machine circuit-allowing relief valve 44 is controlled to 230 kg/cm$^2$.

In addition, a circuit, for sending the switching pressure P1 of the first directional control valve 10 from the second directional control valve 18 to the pressure receiving portion 17 of the first directional control valve 10, is provided with a Hi/Low electromagnetic open/close valve 46 (hereinafter, referred to as electromagnetic open/close valve 46). The electromagnetic open/close valve 46 is connected to a Hi/Low switch 47 for selecting a traveling mode for a high-speed traveling of the vehicle or an operation mode for a low-speed operation, and the operator selects high-speed traveling or low-speed traveling of the vehicle. The electromagnetic open/close valve 46 is communicated when the operator selects Hi (high-speed), and is shut off when Low is selected. When the operator selects Hi (high-speed), the traveling resistance is low, and the speed of the engine 1 is high, pressurized oil, discharged from the working machine hydraulic pump 3, is supplied to the hydraulic travel motor 8 to increase the speed. This allows the vehicle to obtain high-speed traveling. When the operator selects Low (low-speed), pressurized oil, discharged the working machine hydraulic pump 3, is not supplied to the hydraulic travel motor 8 but is supplied only to the working machine valve 13.

Figure 4:
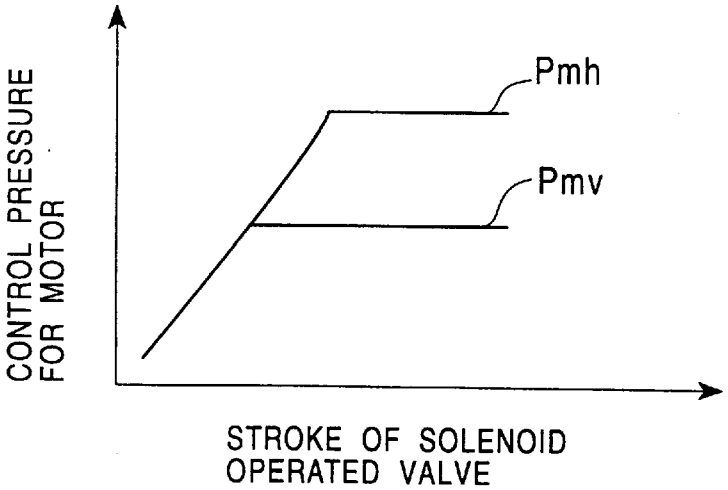
FIG. 4 is a diagram showing control pressure of a hydraulic travel motor according to the present invention.
Figure 5:
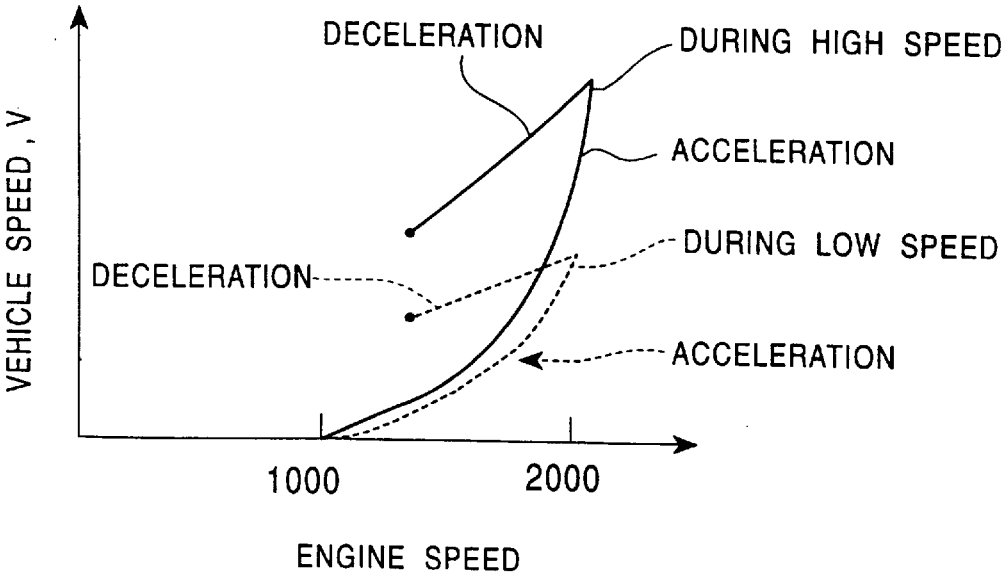
FIG. 5 is a diagram showing acceleration and deceleration during high speed traveling, or during low speed traveling.

A swash plate control means 8*c*, for varying the discharge capacity of the hydraulic travel motor 8, is provided with a motor swash plate electromagnetic open/close valve 48 (hereinafter, referred to as swash plate electromagnetic open/close valve 48). The swash plate electromagnetic open/close valve 48 is connected to the Hi/Low switch 47. The swash plate electromagnetic open/close valve 48 outputs high pressure Pmh to a swash plate control device 8*c* of the hydraulic travel motor 8 when the operator selects Hi (high-speed) of the Hi/Low switch 47, as shown in FIG. 4, and outputs low pressure Pmu to the swash plate control device 8*c* when Low (low-speed) is selected. Incidentally, in FIG. 4, the horizontal axis represents a stroke of the swash plate electromagnetic open/close valve 48, and the vertical axis represents the control pressure supplied to the swash plate control device 8*c* of the hydraulic travel motor 8. By this, when the operator selects Hi (high-speed), the hydraulic travel motor 8 reduces an inclination-rotation angle of the swash plate and the discharge capacity, so that the vehicle can obtain higher-speed traveling. At this time, for example, acceleration and deceleration during high speed, or low speed shown in FIG. 5 are performed. In FIG. 5, the horizontal axis represents the speed of the engine 1, and the vertical axis represents the vehicle speed. Solid lines in this drawing represent actions during high speed, dotted lines represent actions during low speed, and the maximum discharge amount of the hydraulic travel pump 2 and the minimum discharge amount of the hydraulic travel motor 8 are illustrated. When the speed of the engine 1 is increased, the vehicle speed suddenly increases in a curve of secondary degree; and when the speed of the engine 1 is decreased, the vehicle speed linearly decreases. This allows the acceleration characteristics during the increase of the speed to be improved, and allows shock to be reduced because the speed is slowly decreased during deceleration, whereby the driving characteristic is improved.

An operation in the above arrangement will be described. First, a case will be described in which a work is performed in low-speed traveling. The operator set the Hi/Low switch 47 to Low to select the low-speed traveling. This enlarges the inclination-rotation angle of a non-illustrated swash plate of the hydraulic travel motor 8, increases the discharge capacity (cc/rev) of the hydraulic travel motor 8, decreases the rotational speed, and increases the output torque. In addition, the pressurized oil, discharged from the working machine hydraulic pump 3, is supplied only to the working machine cylinder 26, by way of the working machine hydraulic valve 42. In addition, the pressurized oil from the hydraulic travel pump 2 is supplied to the hydraulic travel motor 8. When the operator operates the operating lever 41*a*, attached to the pressure-proportional pressure reduction valve 41, under this condition, the pilot pressure generated at the pressure-proportional pressure reduction valve 41 acts on the working machine hydraulic valve 42 to switch the working machine hydraulic valve 42 in a desired direction. This allows the pressurized oil, discharged from the working machine hydraulic pump 3 to be supplied to the contraction chamber 26*a* or the extension chamber 26*b* of the working machine cylinder 26 by placing the working machine hydraulic valve 42 in its first position F or in its second position G. At this time, similar to the above description, the pressure of the working machine cylinder 26 increases only up to the controlled pressure (for example, 210 kg/cm$^2$) of the working machine relief valve 38, so that the magnitude of thrust of the working machine cylinder 26 corresponds to the controlled pressure of the working machine relief valve 38.

However, during digging, etc., the controlled pressure of the working machine relief valve 38 is often insufficient for a digging force of the bucket. In this case, the operator moves the vehicle forwardly at a low speed, and raises the bucket to increase the digging force. For this operation, when the operator fully operates the operating lever 41*a* to the stroke end, the pressure-proportional pressure reduction valve 41 generates a one-step higher pilot pressure, and the pilot pressure acts on the second pressure receiving portion 43*b* of the hydraulic open/close valve 43. In addition, the pressurized oil from the hydraulic travel pump 2 acts on the first pressure receiving portion 43*a* of one end of the hydraulic open/close valve 43, while the pressurized oil, discharged from the working machine hydraulic pump 3, acts on the third pressure receiving portion 43*c*, and the spring force of the spring 43*d* acts on the second end. At this time, since the controlled pressure of the working machine relief valve 38 acts on the third pressure receiving portion 43*c* of the hydraulic open/close valve 43, when the pressurized oil from the hydraulic travel pump 2 increases to the controlled pressure of the working machine relief valve 38 (for example, 210 kg/cm$^2$) or higher, and the one-step higher pilot pressure from the pressure-proportional pressure reduction valve 41 acts on the second pressure receiving portion 43*b*, opposing the spring force of the spring 43*d*, the hydraulic open/close valve 43 is switched from its shutoff position a to its communication position b. This allows the high pressure oil from the hydraulic travel pump 2 to be supplied to the working machine hydraulic valve 42 through the hydraulic open/close valve 43. The high pressure from the hydraulic travel pump 2 is controlled to 230 kg/cm$^2$ by the working machine circuit-allowing relief valve 44, the working machine can be actuated with this pressure by supplying pressurized oil to the extension chamber 26*b* of the working machine cylinder 26; and the digging force of the working machine cylinder 26 can be increased. At this time, in case of digging a hard rock bed, etc., if the digging force for raising the bucket is insufficient, the operating lever 41*a* can be operated to actuate the bucket by high pressure oil from the hydraulic travel pump 2; and when the bucket is slightly raised to perform digging, the operating lever 41*a* is returned to move the vehicle forwardly by the high pressure oil from the hydraulic travel pump 2, and digging is performed by a tractive force. By this, the hard rock bed, etc., are easily crushed by the raising and pressing of the bucket.

In addition, at this time, the pressure of 230 kg/cm$^2$ controlled by the working machine circuit-allowing relief valve 44 is shut off by the load check valve 15 so as not to act on the working machine hydraulic pump 3. For this reason, the working machine hydraulic pump 3 is restricted to the controlled pressure (for example, 210 kg/cm$^2$), which is within an allowable range of the working machine relief valve 38. At this time, even if the pressurized oil from the hydraulic travel pump 2 reaches the controlled pressure of 420 kg/cm$^2$ of the travel relief valve 37, the hydraulic open/close valve 43 is not switched from its shutoff position a to its communication position b, because the pressing force of the first pressure receiving portion 43*a* is set weaker than the spring force of the spring 43*d*. Therefore, unless the operator fully operates the operating lever 41*a*, the pressurized oil is not supplied from the hydraulic travel pump 2 to the working machine hydraulic valve 42, even if the pressurized oil from the hydraulic travel pump 2 reaches the controlled pressure of 420 kg/cm$^2$ of the travel relief valve 37 during traveling. In addition, even if the hydraulic open/close valve 43 is changed from its shutoff position a to its communication position b, and the pressurized oil from the hydraulic travel pump 2 reaches the controlled pressure of 420 kg/cm$^2$ of the travel relief valve 37, this high pressure is controlled to 230 kg/cm$^2$ by the working circuit-allowing relief valve 44, so that the pressure acting on the working machine cylinder 26 is restricted within the allowable pressure range. In this way, the pressurized oil from the hydraulic travel pump 2 is distributed and supplied to the working machine cylinder 26 and the hydraulic travel motor 8, and the discharge capacity of the hydraulic travel motor 8 is set large, so that the vehicle can move forwardly at a slow speed, and the output torque increases. Therefore, the digging force of the bucket is composed of a large output torque output from the hydraulic travel motor 8, which rotates upon receipt of the pressurized oil distributed from the hydraulic travel pump 2 while moving the vehicle forwardly at a slow speed, and a large force of the working machine cylinder 26 due to the distributed high pressure, so that hard rock bed, etc., can be dug without slipping a tire of the drive wheel 9.

Next, the high-speed traveling will be described. The operator moves the Hi/Low switch 47 to Hi to select the high-speed traveling. This allows the swash plate electromagnetic open/close valve 48 to be communicated, reduces the inclination-rotation angle of the non-illustrated swash plate of the hydraulic travel motor 8, decreases the discharge capacity, and increases the rotational speed. In addition, by moving the Hi/Low switch 47 to Hi, the electromagnetic open/close valve 46 is switched to its communication position b, and supplies the pressurized oil from the second directional control valve 18 to the pressure receiving portion 17 of the first directional control valve 10. By this, the first directional control valve 10 is controlled by the switching pressure P1 of the controlling hydraulic pump 4. Therefore, if the pressure of the hydraulic travel motor 8 is low, and the speed of the engine 1 is high, the first directional control valve 10 is switched, and the pressurized oil, discharged from the working machine hydraulic pump 3, supports the hydraulic travel pump 2. The hydraulic travel motor 8 receives the pressurized oil, discharged by each of the hydraulic travel pump 2 and the working machine hydraulic pump 3, and the rotational speed is increased by the reduction of the discharge capacity (cc/rev) of the hydraulic travel motor 8, thereby traveling the vehicle at high speed. At this time, since the pressurized oil, discharged from the working machine hydraulic pump 3, supports the hydraulic travel pump 2, the working machine cylinder 26 actuates upon receipt of pressurized oil from a non-illustrated steering pump. The non-illustrated steering pump is constructed so that it is driven by the engine 1, and it supplies pressurized oil to a non-illustrated steering cylinder for steering the vehicle, and to the working machine cylinder 26. In addition, the pressurized oil discharged from the working machine hydraulic pump 3, supplies pressurized oil to the working machine cylinder 26 by way of the working machine hydraulic valve 42, or supports the hydraulic travel pump 2 in accordance with the pressure of hydraulic travel motor 8 and the speed of the engine 1, similar to the first embodiment.

Figure 6:
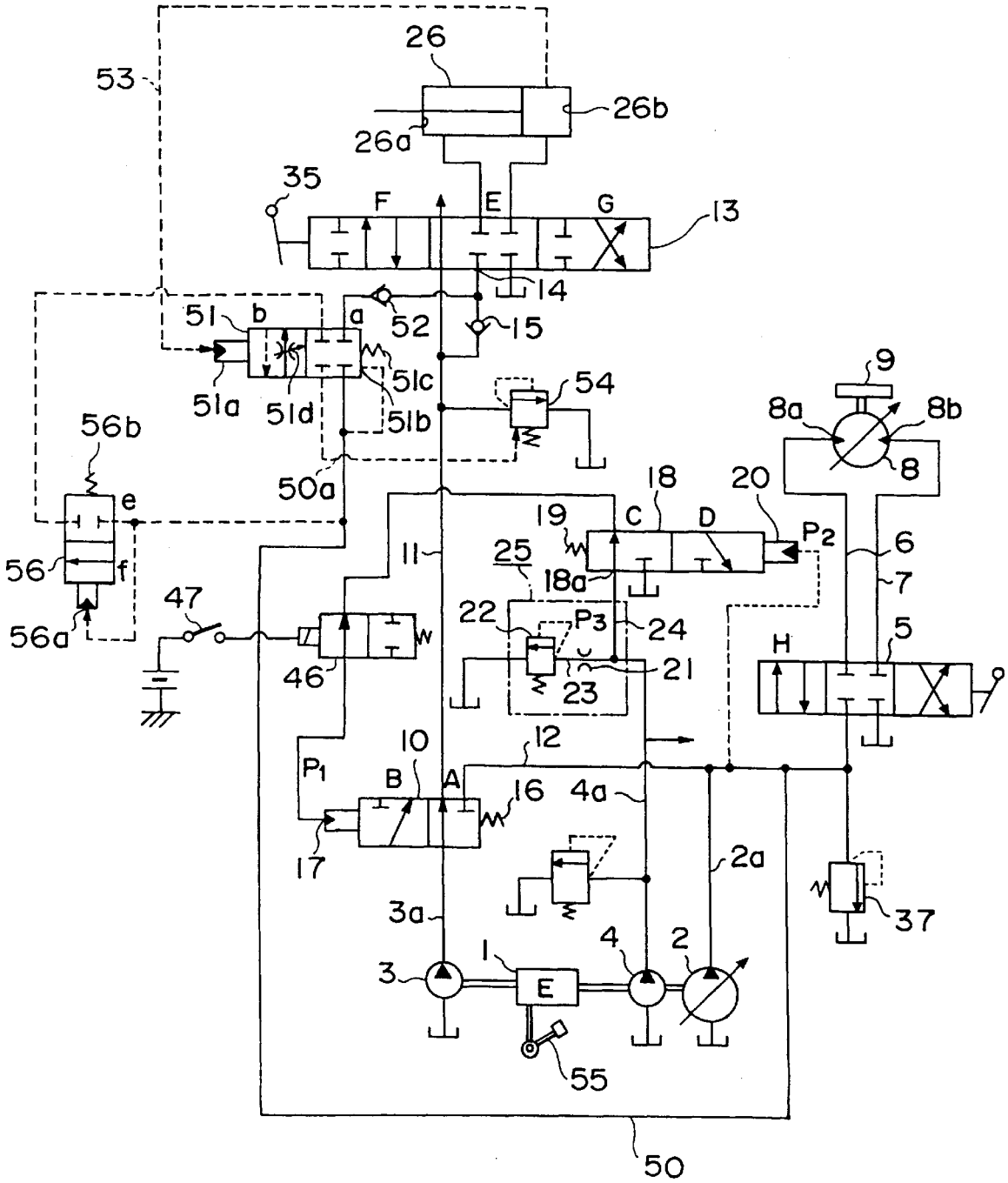
FIG. 6 is a hydraulic circuit diagram showing a fourth embodiment of a hydraulically driven working vehicle according to the present invention.

FIG. 6 is a hydraulic circuit diagram of a fourth embodiment. In the first embodiment, the supply circuit 30 from the hydraulic travel pump 2 is connected between the pump port 14 of the working machine hydraulic valve 13 and the load check valve 15 through the open/close valve 31 having the restrictor 34. However, in the fourth embodiment, as shown in FIG. 6, a second supply circuit 50 from the hydraulic travel pump 2 is, similar to the first embodiment, connected between the pump port 14 of the working machine hydraulic valve 13 and the load check valve 15 by way of a first open/close valve 51 and a first check valve 52. A first pressure receiving chamber 51*a*, connected to the extension chamber 26*b* of the working machine cylinder 26 by a pilot pipe 53, is provided on one end of the first open/close valve 51; and the first pressure receiving chamber 51*b*, connected to the second supply circuit 50, and a spring 51*c* are provided on the other end.

The first open/close valve 51 is actuated against a force adding the force of the spring 51*c* and a force by a predetermined pressure (for example, 210 kg/cm$^2$) acting on the first pressure receiving chamber 51*b*, and is switched from its shutoff position a to its communication position b, to communicate with the second supply circuit 50 when the pressurized oil of the extension chamber 26*b* of the working machine cylinder 26 increases to a controlled pressure (for example, 210 kg/cm$^2$) or higher of a working machine circuit allowed by a relief/unload valve (hereinafter, referred to as relief/unload valve 54), which is described later. In addition, the first open/close valve 51 is switched from its shutoff position a to its communication position b to communicate with the second supply circuit 50 when the pressurized oil of the extension chamber 26*b* of the working machine cylinder 26 increases to the controlled pressure of the relief/unload valve 54 or higher and the pressure acting on the first pressure receiving chamber 51*b* is a predetermined pressure (for example, 210 kg/cm$^2$) or lower. However, the pressurized oil of the extension chamber 26*b* of the working machine cylinder 26 does not flow in the second supply circuit 50 because it is shut off by the first check valve 52. In addition, the first open/close valve 51, when the pressure acting on the first pressure receiving portion 51*b* increases to the second predetermined pressure (for example, 230 kg/cm$^2$) or higher, is switched to its shutoff position a in response to the pressure so as to shut off the second supply circuit 50. This allows the working machine circuit to be restricted to an allowable pressure of the hydraulic equipment.

In addition, the high pressure of the second supply circuit 50 can supply pressurized oil to the second extension chamber 26*b* of the working machine cylinder 26 to operate the working machine, whereby a digging force of the working machine cylinder 26 can be increased. In the above-described embodiment, the first pressure receiving chamber 51*b*, connected to the second supply circuit 50 is provided. However, the first open/close valve 51 can be provided with a variable restrictor 51*d* so that the second supply circuit 50 is shut off by the first open/close valve 51 when the pressure of the second circuit 50 increases to the second predetermined pressure (for example, 230 kg/cm$^2$) or higher.

In addition, although the working machine relief valve 38 is arranged between the load check valve 15 and the first directional control valve 10 in the first embodiment, the relief/unload valve 54 is disposed at the same position in the fourth embodiment. The relief/unload valve 54 restricts the pressure acting on the hydraulic equipment of the working machine circuit side to the allowable pressure of the hydraulic equipment, and unloads the discharge pressure of the working machine hydraulic pump 3 at the time of supporting. To this relief/unload valve 54, the pressure divided from the second supply circuit 50 is supplied by the pilot pipe 50*a* after passing through an open/close valve 56 for the relief valve and the first open/close valve 51. The open/close valve 56 for the relief valve includes a shutoff position e and a communication position f, and the pressure of the second supply circuit 50 acts on a pressure receiving chamber 56*a*, provided on one end, and the force of a spring 56*b* acts on the other end. The open/close valve 56 for the relief valve, when the second supply circuit of the travel circuit increases to 210 kg/cm$^2$ or higher, is switched from its shutoff position e to its communication position f. The relief/unload valve 54 is usually controlled, for example, to 210 kg/cm$^2$.

When the pressure of the extension chamber 26*b* of the working machine cylinder 26 reaches 210 kg/cm$^2$, the first open/close-valve 51 is switched from its shutoff position a to its communication position b, and when the pressure of the second supply circuit 50 of the travel circuit increases to 210 kg/cm$^2$ or higher, the open/close valve 56 for the relief valve is also switched from its shutoff position e to its communication position f. When the first open/close valve 51 and the open/close valve 56 for the relief valve are switched to their communication positions, the pressure of the relief/unload valve 54 is decreased by the pilot pressure (210 kg/cm$^2$ or higher) received through the communication position e of the open/close valve 56 for the relief valve and the communication position b of the first open/close valve 51 so as to be controlled to substantially 0 kg/cm$^2$. By this, the working machine increases the digging force of the working machine cylinder 26 by the high pressure of 210 kg/cm$^2$ or higher from the hydraulic travel pump 2, and the load on the engine 1 is reduced because the pressurized oil of the working machine hydraulic pump 3 decreases to substantially 0 kg/cm$^2$.

In the above-described arrangement, for example, when the working vehicle is a wheel loader, the controlled pressure of the travel relief valve 37 is controlled to 420 kg/cm$^2$, and the controlled pressure of the relief/unload valve 54 is controlled in two steps of higher controlled pressure of 210 kg/cm$^2$, and the controlled pressure of substantially 0 kg/cm$^2$ at the time of unloading. In addition, the switching pressure P1 of the first directional control valve 10 is set so as to be switched at the switching pressure of 10 kg/cm$^2$, which is obtained when the speed of the working vehicle is the speed Na of the engine 1 equivalent to a high speed of 21 km/hour. In addition, the first switching pressure P2 of the second directional control valve 18 is set so as to be switched when the discharge capacity of the hydraulic travel motor 8 is equivalent to a low speed of 12 km/hour of the working vehicle and the output torque Ta of the hydraulic travel motor 8 is the second switching pressure of 180 kg/cm$^2$.

Next, an operation will be described. When the traveling resistance of the drive wheel 9 is low and the load of the hydraulic travel motor 8 is the output torque Ta or lower, i.e., when the pump pressure of the hydraulic travel pump 2 is low (the second switching pressure of 180 kg/cm$^2$ or lower), the pressure of the pressure receiving portion 20 of the second directional control valve 18 decreases to the first switching pressure P2 or lower, to be switched to the supply position C, whereby the upstream pressure P3 of the restrictor 21 is supplied to the pressure receiving portion 17 of the first directional control valve 10. In this state, when the engine 1 is rotating at low speed and the switching pressure P1 of the first directional control valve 10 is the switching pressure of 10 kg/cm$^2$ or lower, or when the Hi/Low switch 47 is selected to be Low, the first directional control valve 10 is placed in the first position A, pressurized oil, discharged from the working machine hydraulic pump 3, is supplied to the working machine valve 13, so that the working machine can be operated by the operation of the working machine valve 13. When the Hi/Low switch 47 is selected to be Low, since the first directional control valve 10 is placed in its first position A, the pressurized oil, discharged from the working machine hydraulic pump 3, is supplied only to the working machine valve 13, similar to the third embodiment, so that the working machine can always be operated.

In addition, when the Hi/Low switch 47 is selected to be Hi for working, the operation is as follows. When the working vehicle is a wheel loader, the condition is such that the speed of the working vehicle is low (a speed of 12 km/hour) and the bucket is dug into the natural ground, and the working machine, such as the bucket, is in an operable condition. The operator digs the working machine into the natural ground at a low speed under this condition, and depresses an accelerator pedal 55 to increase the speed of the engine 1. When the working vehicle is dug into the natural ground, the traveling resistance of the drive wheel 9 becomes high to decrease the speed, and the load loaded on the hydraulic travel motor 8 increases. The pressure applied to the hydraulic travel motor 8 at this time is set to increase to the second switching pressure of 180 kg/cm$^2$ or higher, the pressure acts as the load on the hydraulic travel pump 2 and acts on the pressure receiving portion 20 of the second directional control valve 18. This allows the second directional control valve 18 to be placed in its drain position D, so that the first directional control valve 10 is placed in its first position A, regardless of the engine speed, whereby the pressurized oil, discharged from the working machine hydraulic pump 3, is supplied to the working machine circuit 11.

Therefore, even if the operator depresses the accelerator pedal 55 to increase the speed of the engine 1, the pressurized oil, discharged from the working machine hydraulic pump 3, is supplied to the working machine circuit 11, so that the working machine is operated by the operation of the working machine valve 13. In addition, at this time, even if digging resistance increases during the digging operation, and the pressure in the extension chamber 26*b* of the working machine cylinder 26 reaches the controlled pressure of the relief/unload valve 54 of 210 kg/cm$^2$, there may be a case where a force for raising the bucket is insufficient. In this case, the pressure of 210 kg/cm$^2$ in the extension chamber 26*b* of the working machine cylinder 26 acts on the first open/close valve 51 to automatically switch the first open/close valve 51 to its communication position b. At this time, when the pressure of the second supply circuit 50 of the travel circuit is 210 kg/cm$^2$ or lower, the open/close valve 56 for the relief valve is shut off at its shutoff position e, so that the pressure from the pilot pipe 50, divided from the second supply circuit 50, does not act on the relief/unload valve 54. For this reason, the controlled pressure of the relief/unload valve 54 is maintained at the pressure of 210 kg/cm$^2$.

At this time, the operator depresses the pedal 55 and moves the working vehicle forwardly to increase the pressure of the second supply circuit 50 of the travel circuit to 210 kg/cm$^2$ or higher. When the pressure of the second supply circuit 50 of the travel circuit increases to 210 kg/cm$^2$ or higher, the open/close valve 56 for the relief valve is switched from its shutoff position e to its communication position f, so that the pressure from the pilot pipe 50*a*, divided from the second supply circuit 50, acts on the relief/unload valve 54. For this reason, the controlled pressure of the relief/unload valve 54 decreases to the pressure of substantially 0 kg/cm$^2$, and the pressure of the second supply circuit 50 increases to the pressure of 210 kg/cm$^2$ or higher of the travel circuit, so that this pressure acts on the extension chamber 26*b* of the working machine cylinder 26 by way of the communication position b of the first open/close valve 51, the first check valve 52, and the second position G of the working machine valve 13, whereby the digging force can be increased. In addition, when the pressure is 230 kg/cm$^2$ or higher, the first open/close valve 51 is placed in its shutoff position a. This allows the hydraulic equipment for use in the working machine to be protected because even higher pressure does not act on the working machine valve 13 and the working machine cylinder 26. In addition, when the pressure is 230 kg/cm$^2$ or higher, the controlled pressure of the relief/unload valve 54 is substantially from 0 kg/cm$^2$ to 210 kg/cm$^2$, so that the digging force is maintained.

In addition, when the variable restrictor 51*d* is used, the variable restrictor 51*d* of the first open/close valve 51 is restricted when the pressure of the second supply circuit 50 of the travel circuit is below 230 kg/cm$^2$, and the variable restrictor 51*d* of the first open/close valve 51 is closed when the pressure is 230 kg/cm$^2$ or higher. This allows the hydraulic equipment for the working machine to be protected, similar to the above description.

When traveling with earth and sand loaded on the bucket after the digging has completed, the operator operates the operating lever 35 to return the working machine valve 13 to its neutral position E. This allows the pressurized oil, discharged from the working machine hydraulic pump 3, to return to the tank by way of the neutral position E of the working machine valve 13. At this time, when the operator depresses the accelerator pedal 55 to increase the speed of the engine 1, the discharge pressure of the controlling hydraulic pump 4 is increased by the restrictor 21. In addition, even if the wheel loader loads earth and sand on the bucket, the load loaded on the hydraulic travel motor 8 is small because the traveling resistance of the drive wheel 9 is low on the level ground, and the pressure to be applied to the hydraulic travel motor 8 is set to be the second switching pressure of 180 kg/cm$^2$ or lower. Therefore, since the pressure acting on the pressure receiving portion 20 of the second directional control valve 18 is the second switching pressure of 180 kg/cm$^2$ or lower, the second directional control valve 18 is placed in its position C. By this, the first directional control valve 10 is placed in its second position B, the pressurized oil, discharged from the working machine hydraulic pump 3, is supplied from the support circuit 12 to the normal rotation port 8*a* of the hydraulic travel motor 8 by way of the discharge path 2*a*, the travel valve 5, and the first main circuit 6, and the hydraulic travel motor 8 rotates at a higher speed to increase the vehicle speed.

When traveling with earth and sand loaded on the bucket, and approaching a dump truck to load the earth and sand, the operator eases up on the depressed accelerator pedal 55. By this, the speed of the engine 1 drops, and the rotational speed of the controlling hydraulic pump 4 becomes low, whereby the discharge amount decreases. By this, the pressure of the restrictor 21 decreases, the switching pressure P1 of the first directional control valve 10 decreases to the switching pressure of 10 kg/cm$^2$ or lower, and the first directional control valve 10 is placed in its first position A, whereby the pressurized oil, discharged from the working machine hydraulic pump 3, is supplied to the working machine cylinder 16 through the working machine valve 13, so that the working machine can be operated by the operation of the working machine valve 13. In this way, when Hi is selected, work can be performed, and particularly, when the digging force for digging soft soil, earth, sand, etc., is low, a fast working cycle can be obtained. In addition, as described above, the working machine cylinder 26 can be operated upon receipt of pressurized oil supplied from the non-illustrated steering pump.

In addition, when traveling on the level ground at high speed such as a third speed or a fourth speed, the traveling resistance of the drive wheel 9 is low on the level ground similar to the above description, so that the load loaded on the hydraulic travel motor 8 is low, the pressure applied on the hydraulic travel motor 8 is the second switching pressure of 180 kg/cm$^2$ or lower, and the second directional control valve 18 is placed in its position C. In addition, the operator depresses the accelerator pedal 55 in order to travel at the third speed or the fourth speed. For this reason, the speed of the engine 1 increases, and the discharge pressure of the controlling hydraulic pump 4 is increased by the restrictor 21. By this, the first directional control valve 10 is placed in its second position B, the pressurized oil, discharged from the working machine hydraulic pump 3, is supplied to the normal rotation port 8*a* of the hydraulic travel motor 8 from the support circuit 12 by way of the discharge path 2*a*, the travel valve 5, and the first main circuit 6, and the hydraulic travel motor 8 rotates at higher speed to increase the vehicle speed. When the Hi/Low switch 47 is set to Hi even during this high speed, traveling at a still higher speed than that of the above description can be effected because the discharge capacity of the hydraulic travel motor is small. In addition, even if the engine 1 rotates at a high rotational speed to rotate the working machine hydraulic pump 3 at a high speed, the pressurized oil, discharged from the working machine hydraulic pump 3 does not become resistance because it is supplied to the hydraulic travel motor 8 without racing as usual, so that the engine output can effectively be used. In addition, since the pressurized oil, discharged from the working machine hydraulic pump 3, is always supplied to the hydraulic travel motor 8, traveling at a constant speed responsive to the accelerator can be effected.

Figure 7:
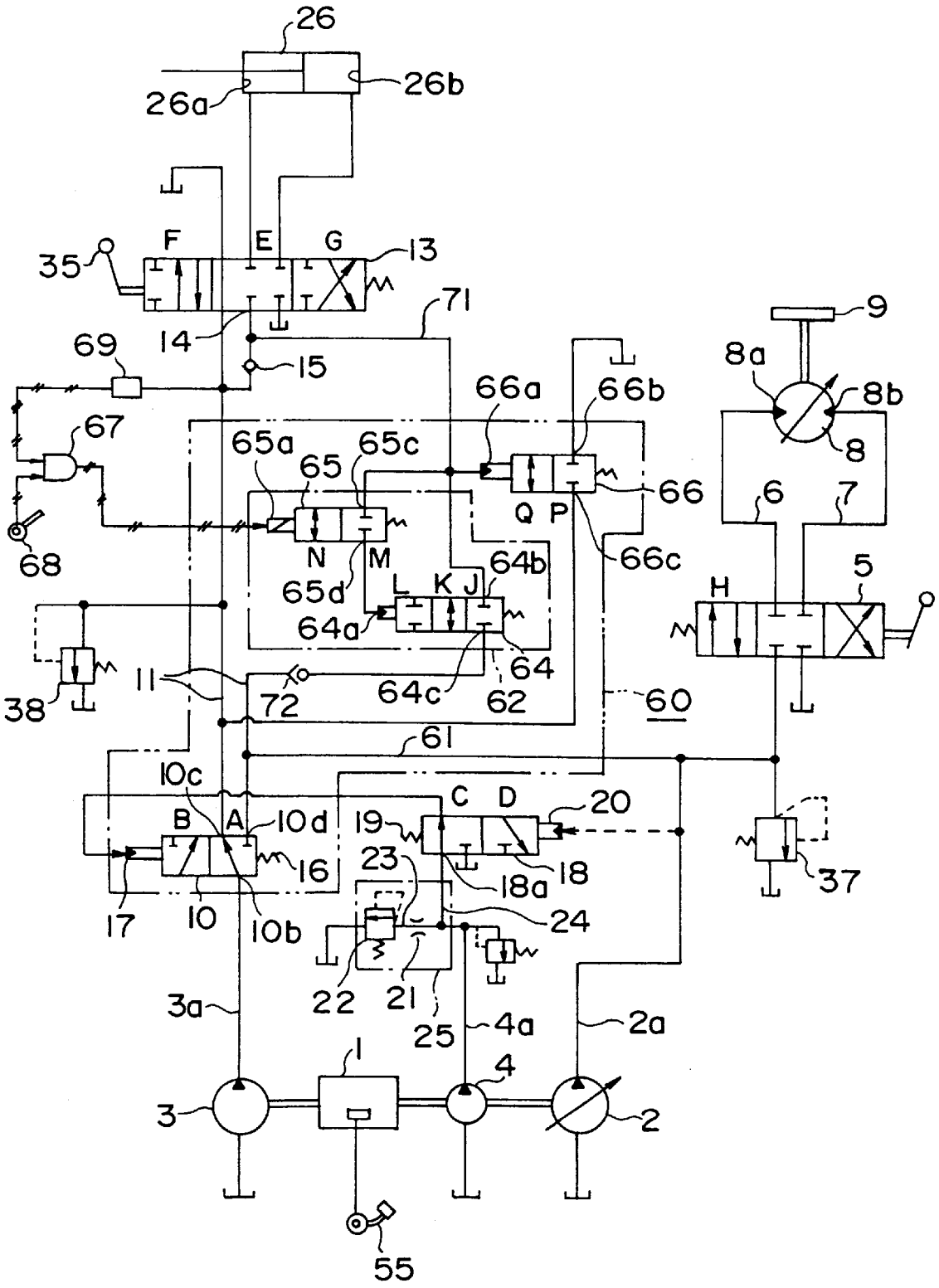
FIG. 7 is a hydraulic circuit diagram showing a fifth embodiment of a hydraulically driven working vehicle according to the present invention.

FIG. 7 is a hydraulic circuit diagram of a fifth embodiment. The flow joining/dividing valve 60 is composed of the first directional control valve 10 for joining to support from the working machine circuit 11 to a travel circuit 61, a third directional control valve 62 for joining to support from the travel circuit 61 to the working machine circuit 11, and an unload valve 66.

The third directional control valve 62 is composed of a working machine supporting valve 64, one port of which is connected to the first directional control valve 10 and the other port of which is connected to the pump port 14 of the working machine valve 13, and a pilot valve 65 for switching the working machine supporting valve 64. The pilot valve 65 comprises a solenoid operated valve having two positions, and the pilot valve 65 is connected to a selector switch 68 for supporting the working machine circuit 11 from the travel circuit 61 by way of an electric AND circuit 67. The AND circuit 67 is connected to the working machine circuit 11 through a working machine pressure sensor 69. In addition, the pump port 14 of the working machine hydraulic valve 13 is connected to the load check valve 15 by a support pipe 71. The support pipe 71 is connected to the working machine supporting valve 64, the pilot valve 65, and a pressure receiving chamber 66*a* of the unload valve 66. In addition, a support circuit check valve 72 is disposed in the support pipe 71, and between the first directional control valve 10 and the working machine supporting valve 64.

In the above-described arrangement, for example, when the working vehicle is a wheel loader, the controlled pressure of the travel relief valve 37 is set to 420 kg/cm$^2$, the controlled pressure of the working machine relief valve 38 is set to 210 kg/cm$^2$, and the unload valve 66 is constructed so as to be changed at 220 kg/cm$^2$. In addition, the working machine supporting valve 64 is constructed so as to be changed from its position J to its position K at 210 kg/cm$^2$, and from its position K to its position L at 250 kg/cm$^2$.

Next, an operation will be described. As regards the first directional control valve 10 for joining the support flow from the working machine circuit 11 to the travel circuit 61, the description will be omitted because it is the same as that of the fourth embodiment. The third directional control valve 62 for supporting from the travel circuit 61 to the working machine circuit 11, and the unload valve 66 will be described.

First, similar to the fourth embodiment, it is assumed that the first directional control valve 10 is placed in its first position A with the load of the hydraulic travel motor 8 being the output torque Ta or higher. By this, the pressurized oil, discharged from the working machine hydraulic pump 3, is supplied to the working valve 13, and the working machine is in the operable condition by the operation of the working valve 13. When the pressure in the extension chamber 26*b* of the working machine cylinder 26 is the controlled pressure of 210 kg/cm$^2$ or lower of the working machine relief valve 38 under this condition, the pressurized oil, discharged from the working machine hydraulic pump 3, is supplied to the extension chamber 26*b* of the working machine cylinder 26 by way of the second position B of the first directional control valve 10 and the position G of the working valve 13, so as to extend the working machine cylinder 26. In addition, the pressure reaches the working machine supporting valve 64, the pilot valve 65, and the pressure receiving chamber 66*a* of the unload valve 66 by the support pipe 71. Since the pilot valve 65 is shut off at its shutoff position M, the pressure in the extension chamber 26*b* from the support pipe 71 does not reach the pressure receiving chamber 66*a* of the working machine supporting valve 64. For this reason, the working machine supporting valve 64 is placed in its shutoff position J, and the travel circuit 61 and the working machine circuit are shut off, so that the hydraulic travel pump 2 does not support the working machine hydraulic pump 3. In addition, the pressure in the extension chamber 26*b* from the support pipe 71, reaching the pressure receiving portion 66*a* of the unload valve 66, is 220 kg/cm$^2$ or lower, so that the unload valve 66 stops in its shutoff position P, and the pressurized oil, discharged from the working machine hydraulic pump 3, is shut off and not unloaded.

Next, when the pressure in the extension chamber 26*b* of the working machine cylinder 26 is the controlled pressure of 210 kg/cm$^2$ or higher of the working machine relief valve 38, the working machine relief valve 38 is operated to control the pressure of the working machine circuit 11 to the controlled pressure of 210 kg/cm$^2$. There may be a case where the force for raising the bucket is insufficient even if the controlled pressure of the working machine circuit 11 reaches 210 kg/cm$^2$. At this time, the operator turns on the selector switch 68 for supporting. In addition, at this time, a signal from the working machine pressure sensor 69, connected to the working machine circuit 11, enters the AND circuit 67. By the two signals from the selector switch 68 and the working machine pressure sensor 69, the AND circuit 67 outputs a signal to the solenoid 65*b* of the pilot valve 65 to switch the pilot valve 65 from its shutoff position M to its communication position N. This allows the pressure of 210 kg/cm$^2$ or higher of the extension chamber 26*b* from the support pipe 71 to reach the pressure receiving chamber 64*a* of the working machine supporting valve 64, thereby switching the working machine supporting valve 64 from its shutoff position J to its communication position K. For this reason, the travel circuit 61 is in communication with the working machine circuit 11, and the hydraulic travel pump 2 supports the working machine hydraulic pump 3.

At this time, when the pressure of the hydraulic travel pump 2 is 210 kg/cm$^2$ or lower, the hydraulic travel pump 2 does not support the working machine hydraulic pump 3, and back flow from the working machine hydraulic pump 3 to the hydraulic travel pump 2 is prevented by the support circuit check valve 72. In addition, at this time, the operator increases the forward force obtained by rotating the engine 1 at a high speed, i.e., the pressure of the hydraulic travel motor 8 is increased to raise the output torque while holding the bucket in abutment with the rock base, etc., and supports this pressure from the hydraulic travel pump 2 to the working machine hydraulic pump 3. By this, the rock base, etc., can easily be dug by a resultant force of bucket raising force and forward force. When the pressure supported by the hydraulic travel pump 2 increases to 220 kg/cm$^2$ or higher, the unload valve 66 is switched to its communication position Q, and the pressurized oil, discharged from the working machine hydraulic pump 3, is communicated with the tank to be unloaded. This allows the pressurized oil, discharged from the working machine hydraulic pump 3, to decrease substantially to 0 kg/cm$^2$, so that the load of the engine 1 is lightened, and a surplus force is generated in the output.

Further, when the pressure in the extension chamber 26*b* of the working machine cylinder 26 increases to reach 250 kg/cm$^2$, the pressure of 250 kg/cm$^2$ in the extension chamber 26*b* from the support pipe 71 reaches the pressure receiving chamber 66*a* of the working machine supporting valve 64, and switches the working machine supporting valve 64 from its communication position K to its shutoff position L. For this reason, the working machine supporting valve 64 shuts off the travel circuit 61 and the working machine circuit 11 again, and reduces the pressure of the support pipe 71. For this reason, the force for raising the bucket increases until the pressure in the extension chamber 26*b* of the working machine cylinder 26 reaches 250 kg/cm$^2$, and even higher pressure does not go from the travel circuit 61 to the working machine circuit 11. Thus, the allowable pressure of the hydraulic equipment for the working machine circuit 11 is maintained. In addition, when the pressure in the extension chamber 26*b* of the working machine cylinder 26 increases to 250 kg/cm$^2$ or higher, the unload valve 66 is switched to its shutoff position P to reduce the pressure of the support pipe 71. For this reason, the pressure of the pressurized oil, discharged from the working machine hydraulic pump 3, decreases to 220 kg/cm$^2$ again, so that the pressure in the extension chamber 26*b* of the working machine cylinder 26 is maintained at 220 kg/cm$^2$.

In the above-described embodiment, the pilot valve 65 is switched by the AND circuit 67 receiving two signals from the selector switch 68 and the working machine pressure sensor 69. However, the pilot valve 65 can be switched by either signal alone.

Figure 8:
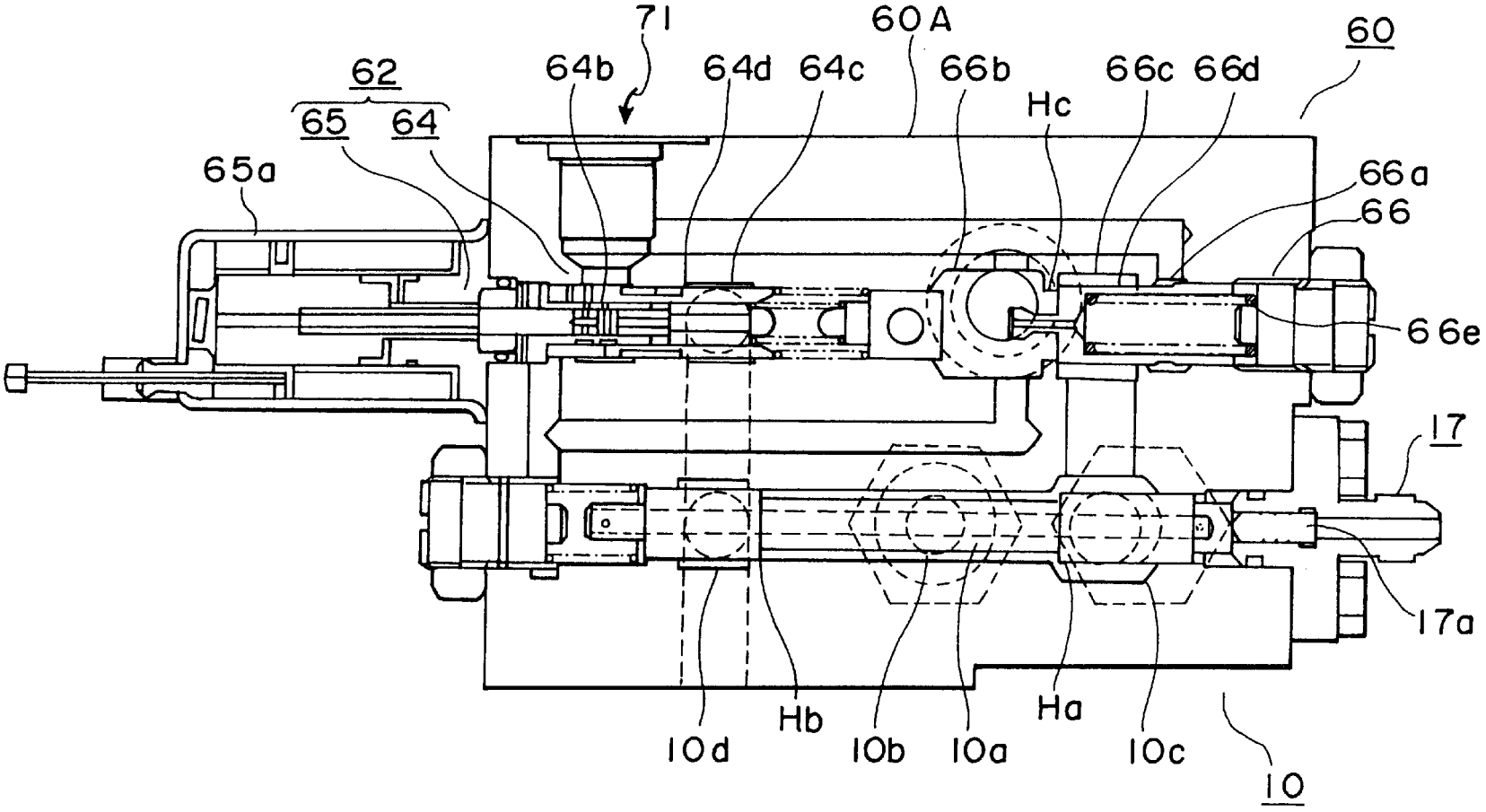
FIG. 8 is a sectional view of a flow joining/dividing valve according to the fifth embodiment.

FIG. 8 is a sectional view of the flow joining/dividing valve 60 in the fifth embodiment. The flow joining/dividing valve 60 includes the first directional control valve 10, the third directional control valve 62, and the unload valve 66, accommodated in a one-piece body 60A. FIGS. 9 to 12 illustrate the operation of the third directional control valve 62. Referring to FIG. 8, a piston 17*a* of the pressure receiving portion 17 is disposed on the right end of the first directional control valve 10. A spool 10*a* is disposed in abutment with the piston 17*a*, and a pump port 10*b* from the working machine hydraulic pump 3, is disposed in the center of the spool 10*a*. In addition, a working machine port groove 10*c*, to the working machine valve 13 and the unload valve 66 is disposed on the right of the spool 10*a*, between the pump port 10*b* and the piston 17*a*, and a travel port groove 10*d*, to the travel valve 5 and the working machine supporting valve 64 is disposed on the left side.

The third directional control valve 62 and the unload valve 66 are arranged on the same line, and the third directional control valve 62 is arranged to the left in the drawing, while the unload valve 66 is arranged to the right in the drawing. A tank groove 66*b* is provided in left end of the unload valve 66; an unloading port groove 66*c*, connected to the working machine port groove 10*c* of the first directional control valve 10, is provided in its right side; and further, a pressure receiving chamber 66*a* is provided on its right side.

In the third directional control valve 62 including the working machine supporting valve 64 and the pilot valve 65, the pilot valve 65 is accommodated inside of the working machine supporting valve 64 so as to be integrally formed. In addition, on the left side of the drawing opposite to the unload valve 66, a solenoid 65*a* for the pilot valve 65 is disposed. A supporting first port 64*b*, linked to the support pipe 71 connected to the working machine valve 13, is arranged on the right side of the solenoid 65*a*; and a supporting second port 64*c*, linked to the travel port groove 10*d* of the first directional control valve 10, is arranged on its right side.

Figure 9:
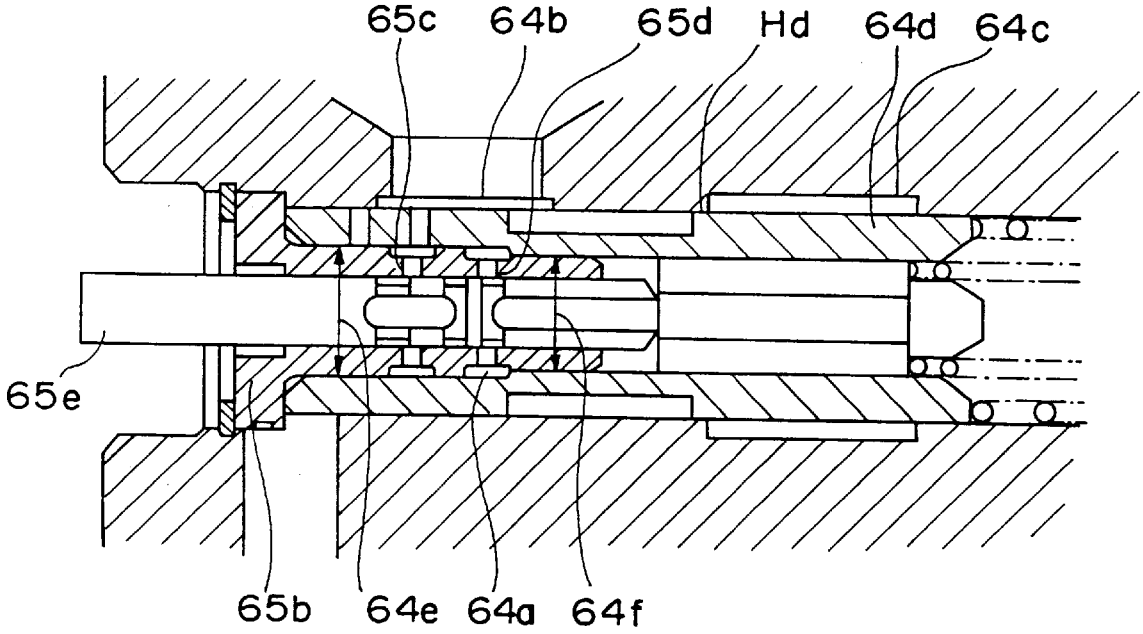
FIG. 9 illustrates an operation of a third directional control valve according to the fifth embodiment, and shows a state in which a solenoid for a pilot valve is not excited.

Referring to FIG. 9, in a hole linked to the supporting first port 64*b* and the supporting second port 64*c*, a supporting spool 64*d* is disposed; and a spool hole 64*e*, having a large diameter, and a spool hole 64*f*, having a small diameter, are formed inside the supporting spool 64*d*. A pressure receiving area is provided by the difference between the diameters so as to constitute a pressure receiving portion 64*a*. In a fixed sleeve 65*b* of the pilot valve 65, inserted into the inner diameters of the spool holes 64*e* and 64*f*, a first drill hole 65*c*, linked to the support pipe 71, and a second drill hole 65*d*, linked to the pressure receiving chamber 64*a*, are formed.

Next, an operation of the flow joining/dividing valve 60 will be described.

Referring to FIG. 8, when the pressurized oil does not act on the piston 17*a* of the pressure receiving portion 17, the first directional control valve 10 is opened at a position Ha of the spool 10*a*, and shut off at a position Hb of the spool 10*a*, whereby the pump port 10*b* and the working machine port groove 10*c* are connected. This is equivalent to the first position A of the first directional control valve 10 shown in FIG. 7. When the pressurized oil acts on the piston 17*a*, the first directional control valve 10 is opened at the position Hb of the spool 10*a*, whereby the pump port 10*b* and the travel port groove 10*d* are connected, and is shut off at the position Ha of the spool 10*a*, whereby the pump port 10*b* and the working machine port groove 10*c* are shut off. This is equivalent to the second position B of the first directional control valve 10 shown in FIG. 7.

The unload valve 66 is mainly composed of a check valve 66*d* and a spring 66*e*, and the check valve 66*d* is constructed to have a small diameter on the left side of the pressure receiving chamber 66*a*, and to have a large diameter on the right side; and a pressure receiving area, for receiving the pressure of the pressure receiving chamber 66*a* acting on the check valve 66*d*, is provided. When the pressure of the pressure receiving chamber 66*a*, linked to the support pipe 71, is a predetermined pressure or lower, the check valve 66*d* is pressed leftwardly in the drawing by the spring 66*e*, whereby the tank groove 66*b* and the unloading port groove 66*c* are shut off at a position Hc. This is equivalent to the shutoff position P of the unload valve 66 shown in FIG. 7. When the pressure of the pressure receiving chamber 66*a* increases to the predetermined pressure or higher, the check valve 66*d* moves rightwardly in the drawing against the spring 66*e*, whereby the tank groove 66*b* and the unloading port groove 66*c* are opened at the position Hc. This is equivalent to the communication position Q of the unload valve 66 shown in FIG. 7.

An operation of the third directional control valve 62 will be described with reference to FIGS. 9 to 12.

In FIG. 9, a drawing is shown in which the solenoid 65*a* for the pilot valve 65 is not excited, and the second drill hole 65*c*, linked to the support pipe 71, and the first drill hole 65*d*, linked to the pressure receiving chamber 64*a*, are shut off by a valve rod 65*e*. This position is the shutoff position M of the pilot valve 65 in FIG. 7. By this, since the pressurized oil does not acts on the pressure receiving chamber 64*a* of the working machine supporting valve 64, the supporting spool 64*d* does not move, so that the supporting first port 64*b*, linked to the support pipe 71, and the traveling port groove 10*d*, of the first directional control valve 10, are shut off by the supporting spool 64*d* at the position Hd. This state shows the shutoff position J of the working machine supporting valve 64 in FIG. 7.

Figure 10:
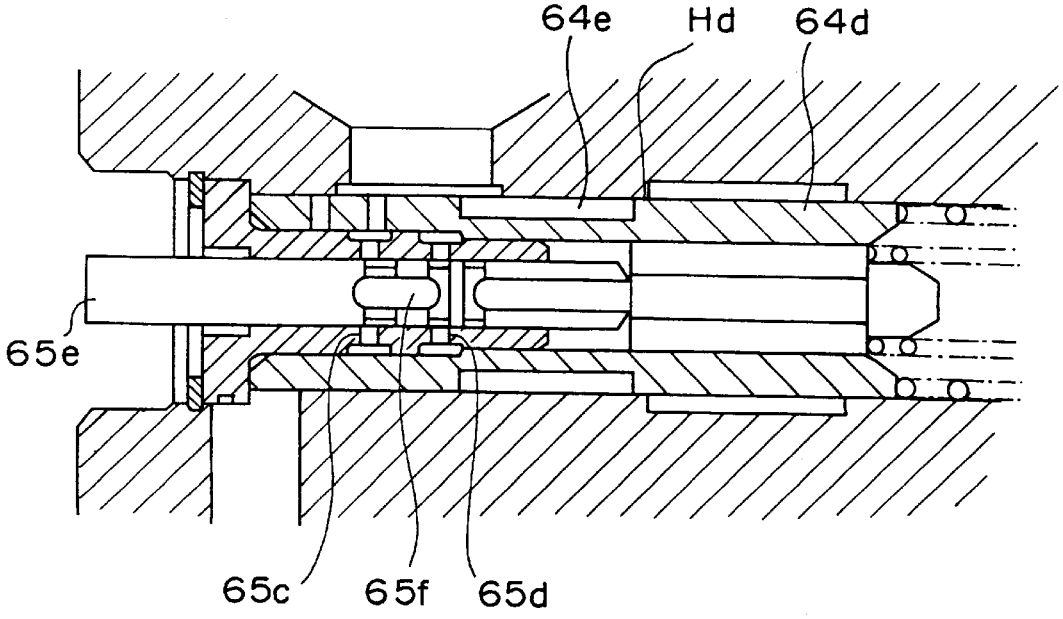
FIG. 10 illustrates the operation of the third directional control valve according to the fifth embodiment, and shows a state in which the solenoid for the pilot valve is excited, and a supporting spool has not moved yet.

In FIG. 10 a state is shown in which the solenoid 65*a* for the pilot valve 65 is excited, and the supporting spool 64*d* has not moved yet. The first drill hole 65*c* is in communication with the second drill hole 65*d* by a slit 65*f* in the valve rod 65*e*. This position is the communication position N of the pilot valve 65 in FIG. 7. This allows the pressurized oil to act on the pressure receiving chamber 64*a* of the working machine supporting valve 64, so that the supporting spool 64*d* starts to move when the pressure becomes a first predetermined pressure.

Figure 11:
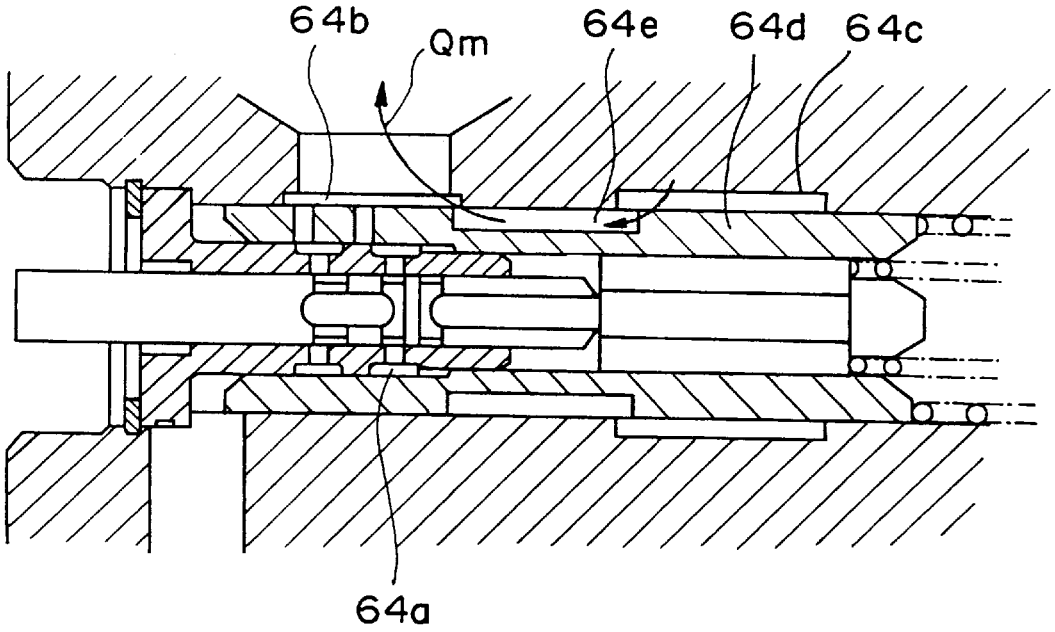
FIG. 11 illustrates the operation of the third directional control valve according to the fifth embodiment, and shows a state in which the solenoid for the pilot valve is excited, and the supporting spool is moving.

In FIG. 11, a state is shown in which the solenoid 65*a* of the pilot valve 65 is excited, and the supporting spool 64*d* is moving. The first drill hole 65*c* is in communication with the second drill hole 65*d* via the slit 65*f* of the valve rod 65*e*, and this position is the communication position N of the pilot valve 65 in FIG. 7. This allows the pressurized oil of the first predetermined pressure to act on the pressure receiving chamber 64*a* of the working machine supporting valve 64 to move the supporting spool 64*d*, so that the supporting first port 64*b*, linked to the support pipe 71, is in communication with the travel port groove 10*d* of the first directional control valve 10 via the slit 64*e* at the position Hd. This state shows the communication position K of the working machine supporting valve 64 in FIG. 7.

Figure 12:
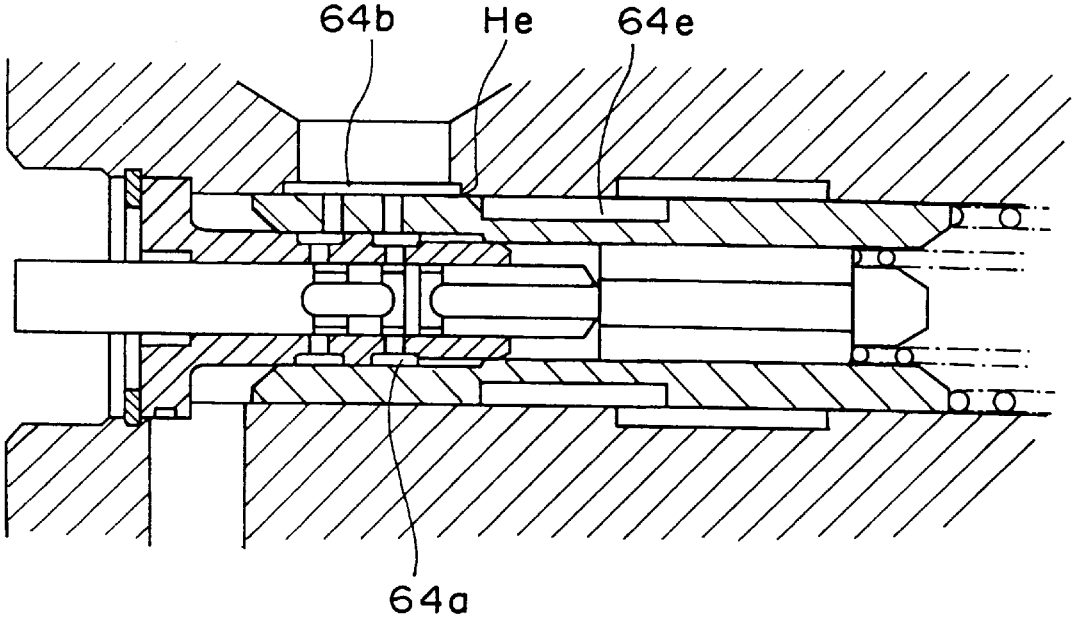
FIG. 12 illustrates the operation of the third directional control valve according to the fifth embodiment, and shows a state in which the solenoid for the pilot valve is excited, and the supporting spool is moving further rightward in the drawing.

FIG. 12 shows a state in which the solenoid 65*a* for the pilot valve 65 is excited, and the supporting spool 64*d* moves further rightwardly in the drawing. The first drill hole 65*c* is in communication with the second drill hole 65*d* via the slit 65*f* of the valve rod 65*e*, and this position is the communication position N of the pilot valve 65 in FIG. 7. This allows the pressurized oil of the second predetermined pressure to act on the pressure receiving chamber 64*a* of the working machine supporting valve 64 to move the supporting spool 64*d* further rightwardly in the drawing, so that the supporting first port 64*b*, linked to the support pipe 71, and the travel port groove 10*d*, of the first directional control valve 10, are shut off by the slit 64*e* of the supporting spool 64*d* at the position He.

This state shows the shutoff position L of the working machine supporting valve 64 in FIG. 7. This allows the working machine supporting valve 64, when pressurized oil of the first predetermined pressure is present, to communicate the supporting first port 64*b*, linked to the support pipe 71, with the travel port groove 10*d* of the first directional control valve 10, and the pressurized oil (arrow Qm) is fed from the travel port groove 10*d* to the supporting first port 64*b*. When the pressurized oil of the second predetermined pressure is present, the supporting first port 64*b*, linked to the support pipe 71, and the travel port groove 10*d*, of the first directional control valve 10, are shut off, so that the flow of pressurized oil from the travel port groove 10*d* to the supporting first port 64*b* stops again. This allows the pressurized oil of the circuit of the working machine valve 13 to be maintained to the second predetermined pressure or lower.

Figure 13:
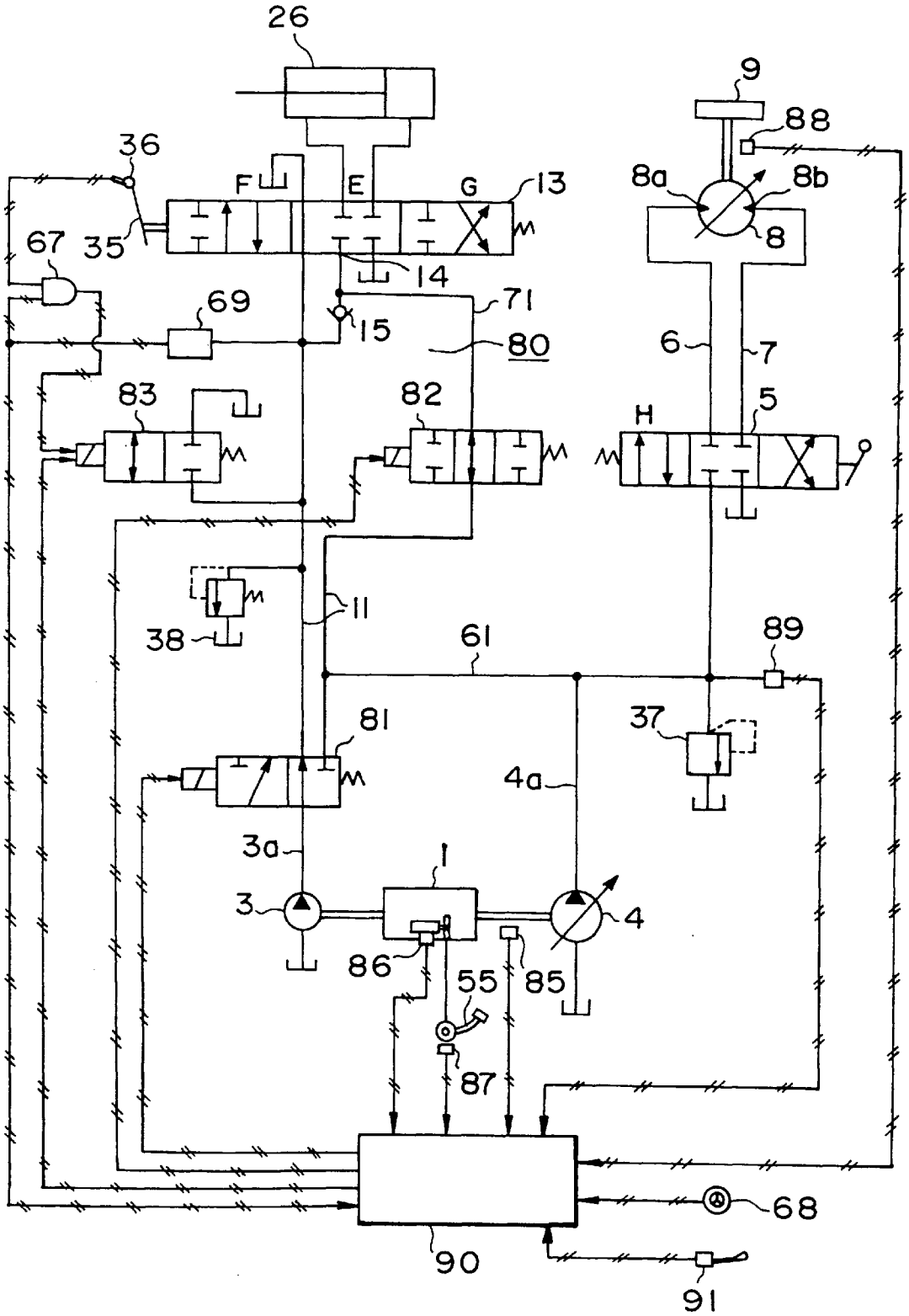
FIG. 13 is a hydraulic circuit diagram showing a sixth embodiment of a hydraulically driven working vehicle according to the present invention.

FIG. 13 is a hydraulic circuit diagram of a sixth embodiment. Although the pilot oil pressure is used for controlling the valves in the fifth embodiment, an example is shown in the sixth embodiment in which the valves are controlled by electric connections. Therefore, the number of ports, the positions, and the functions of the respective valves are the same as those of the fifth embodiment.

An electromagnetic flow joining/dividing valve 80 is composed of an electromagnetic first directional control valve 81 for joining to support from the working machine circuit 11 to the travel circuit 61, an electromagnetic third directional control valve 82 for supporting from the travel circuit 61 to the working machine circuit 11, and an electromagnetic unload valve 83. An engine speed sensor 85 for measuring the engine speed, a fuel injection amount sensor 86 for measuring the fuel injection amount of the engine 1, or an accelerator lever position sensor 87 for measuring an accelerating amount of the accelerator lever are attached to the engine 1.

In addition, to the hydraulic travel motor 8, a travel speed sensor 88 for measuring the traveling speed by the hydraulic travel motor 8, and a travel pressure sensor 89 for measuring traveling torque applied to the hydraulic travel motor 8 are attached. In addition, a controller 90 is provided for controlling the electromagnetic flow joining/dividing valve 80 upon receipt of signals from these sensors. The controller 90 is provided with a speed change lever position sensor 91, attached to a speed change lever.

Figure 14:
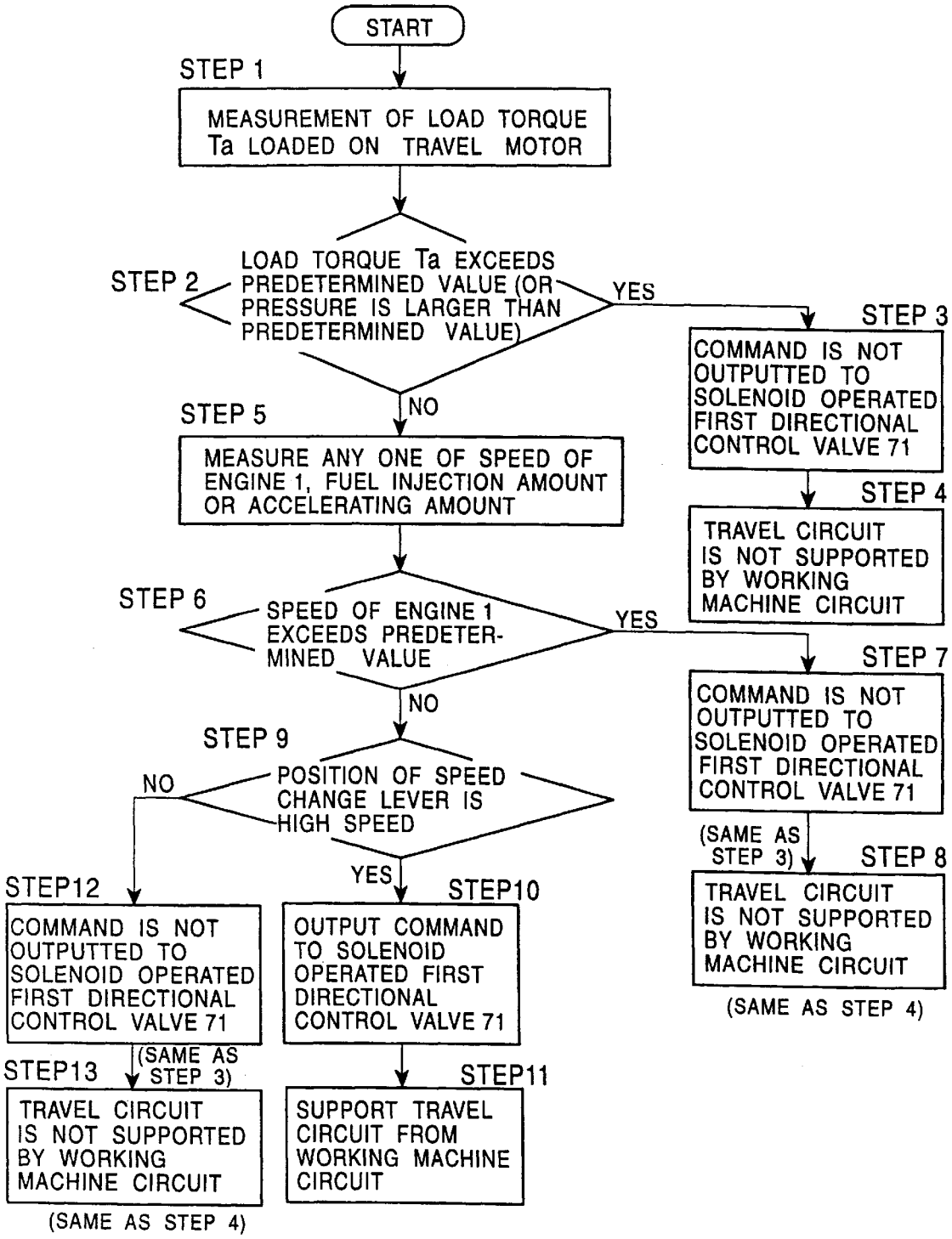
FIG. 14 is a flowchart of supporting from a working circuit to a travel circuit according to the sixth embodiment.

Next, an operation will be described by a flowchart of FIG. 14.

In step 1, the travel pressure sensor 89 measures the discharge pressure of the hydraulic travel pump 2 in order to measure the traveling torque Ta exerted on the hydraulic travel motor 8. In step 2, it is judged whether or not the pressure applied to the hydraulic travel motor 8 exceeds a predetermined value. When the pressure exceeds in step 2, the procedure advances to step 3. In step 3, when the pressure applied to the hydraulic travel motor 8 exceeds the predetermined value, the controller 90 does not output a switching command to the electromagnetic first directional control valve 81. By this, in step 4, the working machine circuit 11 drives the working machine without joining to support from the working machine circuit 11 to the travel circuit 61. Incidentally, when the pressure does not exceed the predetermined value in step 2, the procedure advances to step 5.

In step 5, the engine speed sensor 85 measures the speed of the engine 1, the fuel injection amount of the engine 1 is measured by the fuel injection amount sensor 86, or the accelerating amount of the accelerator lever is measured by the accelerator lever position sensor 87. In step 6, it is judged whether or not the speed of the engine 1 is a predetermined speed. When the speed of the engine 1 is the predetermined speed or less, the procedure advances to step 7. In step 7, the controller 90 does not output a switching command to the electromagnet first directional control valve 81. By this, in step 8, the working machine circuit 11 drives the working machine without joining to support from the working machine circuit 11 to the travel circuit 61. When the speed of the engine 1 is greater than the predetermined speed, the procedure advances to step 9.

In step 9, it is judged whether or not the speed change lever position sensor 91 is placed in the high speed of the fourth speed or the fifth speed. In step 9, when the speed change lever position sensor 91 is placed in the high speed of the fourth speed or the fifth speed, the procedure advances to step 10. In step 10, the controller 90 outputs a switching command to the electromagnetic first directional control valve 81. By this, in step 11, the hydraulic travel motor 8, joining to support from the working machine circuit 11 to the travel circuit 61, rotates at high speed. In step 9, when the speed change lever position sensor 91 is not placed in the high speed of the fourth speed or the fifth speed, the procedure advances to step 12.

In step 12, the controller 90 does not output a switching command to the electromagnetic first directional control valve 81. By this, in step 13, the working machine circuit 11 drives the working machine without joining to support from the working machine circuit 11 to the travel circuit 61. Incidentally, although the speed of the engine 1 and the speed change position of the speed change lever position sensor 91 are detected and judged in the above description, the speed of the hydraulic travel motor 8 can be detected and judged by the travel speed sensor 85.

That is to say, in place of step 6 and step 9, whether or not the hydraulic travel motor 8 rotates at the predetermined speed or higher is judged. When it is the predetermined speed or higher, the procedure advances to step 10, and the procedure advances to step 12 when it is less than the predetermined speed. In addition, although it is judged whether or not the speed change lever position sensor 91 is placed in the high speed of the fourth speed or the fifth speed in step 9, it can be judged by the Hi/Low switch 47 in the third embodiment.

In addition, in the above description, when the flow is not joined to support from the working machine circuit 11 to the travel circuit 61, and the pressure in the extension chamber 26*b* of the working machine cylinder 26 is the controlled pressure of 210 kg/cm$^2$ or higher of the working machine relief valve 38 in step 4 and step 10, or step 12, the electromagnetic third directional control valve 82 is switched to support the working machine circuit 11 from the travel circuit 61 similar to the fourth embodiment or the fifth embodiment, and the electromagnetic unload valve 83 is switched to unload the working machine hydraulic pump 3, thereby reducing the load acting on the working machine hydraulic pump 3.

Figure 15:
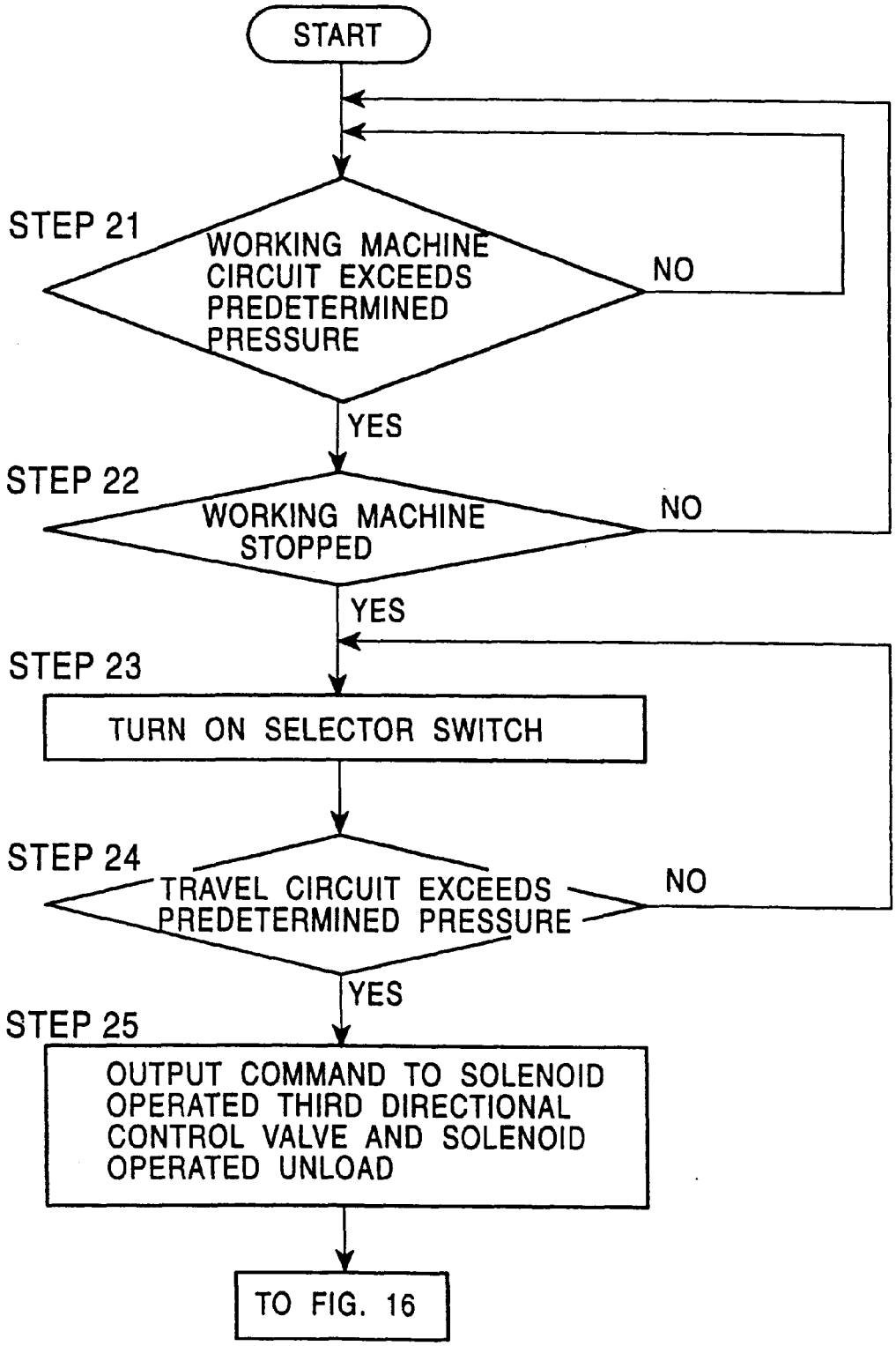
FIG. 15 is a flowchart of supporting from the travel circuit to the working circuit according to the sixth embodiment.
Figure 16:
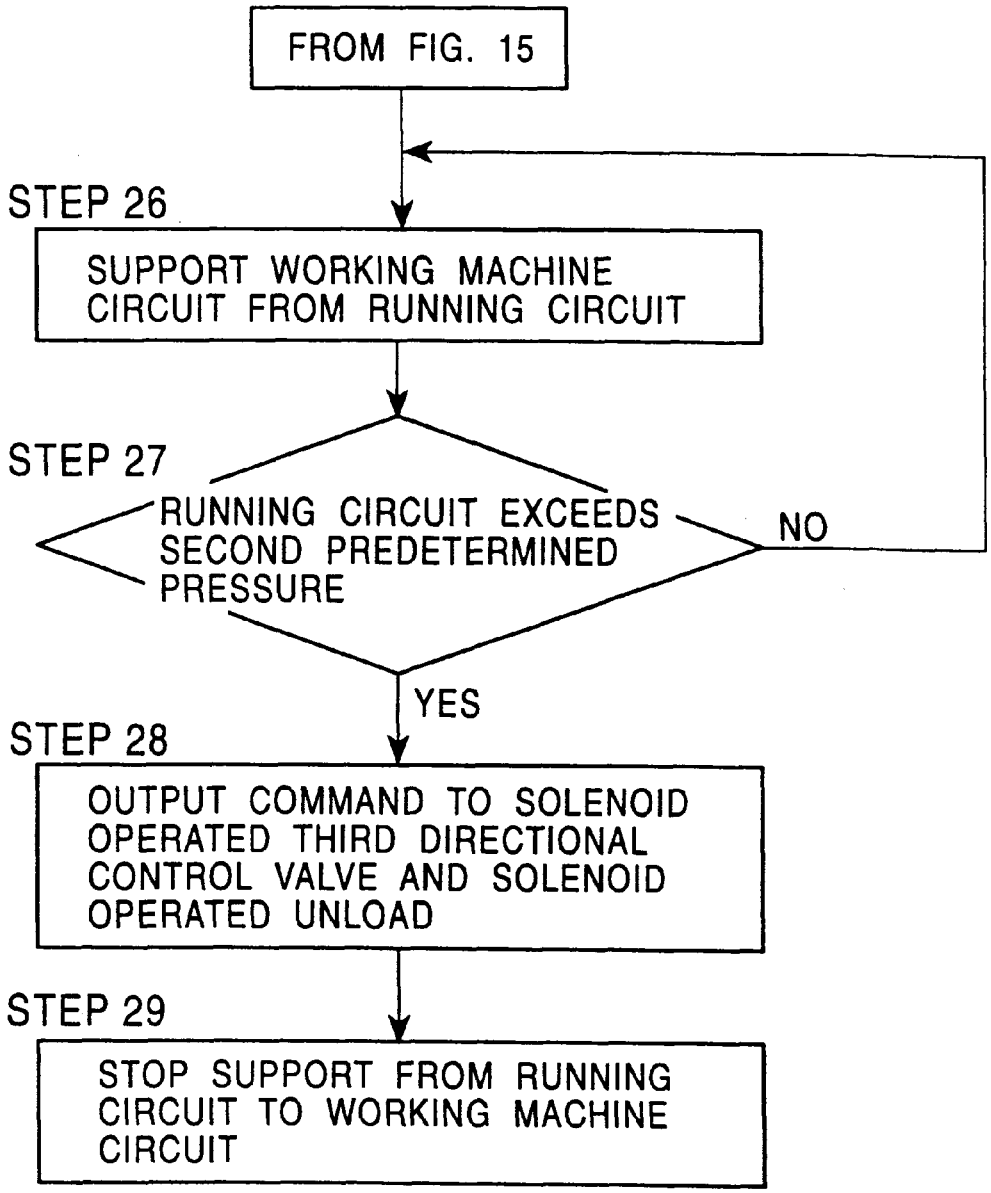
FIG. 16 is a flowchart of supporting from the travel circuit to the working circuit according to the sixth embodiment.

Next, a case in which the working machine circuit 11 is supported by the travel circuit 61 will be described with reference to FIG. 15 and FIG. 16. In step 21, it is judged whether or not the controlled pressure of the working machine circuit 11 exceeds a predetermined pressure (for example, 210 kg/cm$^2$) This is measured by the working machine pressure sensor 69, connected to the working machine circuit 11, and is used for the judgment as to whether or not the force for raising the bucket is insufficient even if the controlled pressure exceeds the predetermined pressure (210 kg/cm$^2$)

In the case of NO in step 21, the procedure returns to step 21 again. In step 22, the operator watches the movement of the working machine (for example, bucket) to judge whether or not the working machine has stopped. When stopped, it is judged that the force for raising the working machine is insufficient. Therefore, in the case of NO, the procedure returns to step 21. When the working machine is stopped, the procedure advances to step 23. In step 23, the selector switch 68 is operated to be turned ON. In step 24, it is judged whether or not the oil pressure of the travel circuit 61 exceeds a predetermined pressure (for example, 220 kg/cm$^2$).

In step 25, the controller 90 outputs a switching command to the electromagnetic third directional control valve 82 and the electromagnetic unload valve 83 by a signal of exceeding the predetermined pressure (210 kg/cm$^2$) from the working machine pressure sensor 69, an ON signal operated from the selector switch 68, and a signal of exceeding the predetermined pressure (220 kg/cm$^2$) from the travel pressure sensor 89.

In step 26, the electromagnetic third directional control valve 82 and the electromagnetic unload valve 83 are switched, the hydraulic travel pump 2 supports the working machine circuit 11, and the working machine hydraulic pump 3 is unloaded to reduce the load acting on the working machine hydraulic pump 3. The pressure supporting from the hydraulic travel pump 2 increases to 220 kg/cm$^2$ or higher, whereby the force for raising the bucket increases.

In step 27, the pressure supported from the hydraulic travel pump 2 increases, and it is judged whether or not the increased pressure reaches 250 kg/cm$^2$. In case of NO, the procedure returns to step 21. When the pressure reaches 250 kg/cm$^2$ in step 27, the procedure advances to step 28. In step 28, the controller 90 outputs a command, for stopping the support from the hydraulic travel pump 2 to the working machine circuit 11, to the electromagnetic third directional control valve 82. In step 29, the electromagnetic third directional control valve 82 is switched to stop the support.

By the steps as described above, the pressure in the extension chamber 26*b* of the working machine cylinder 26 increases the force for raising the bucket of 250 kg/cm$^2$, and even higher pressure does not go from the travel circuit 61 to the working machine circuit 11, so that allowable pressure of hydraulic equipment for the working machine circuit 11 is maintained.

In the above embodiment, the switching effected by two signals from the selector switch 68 and the working machine pressure sensor 69 is described. However, the electromagnetic unload valve 83 can be energized by only a signal from the working machine pressure sensor 69, only a signal from the switch 36 attached to the operating lever 35, or by two signals from the switch 36 and the working machine pressure sensor 69. In addition, although the description is given by the electromagnetic hydraulic equipment, it is appreciated that the valves can be similarly controlled by hydraulically operated hydraulic equipment like the third embodiment.

In addition, in the above embodiment, the description is given of the allowable pressure for the working machine by providing numerical values, for example, 250 kg/cm$^2$, etc. However, it is appreciated that an allowable pressure is not restricted thereto and can be selected in accordance with its circuit.

INDUSTRIAL APPLICABILITY

The present invention is useful as a hydraulic circuit for a hydraulically driven working vehicle, such as a wheel loader, a crane truck, or a construction vehicle, etc., which allows the vehicle to travel at an almost constant speed during high-speed traveling, provides a large digging force during working, does not need charging pressure for preventing cavitation, loses a small amount of energy, and has a simple structure.

We claim:

1. A hydraulic circuit for a hydraulically driven working vehicle having an engine, said hydraulic circuit comprising:

a hydraulic travel circuit which includes a hydraulic travel motor for driving the vehicle;

a hydraulic travel pump for discharging pressurized oil to the hydraulic travel circuit, said hydraulic travel pump being drivable by the engine;

a working machine-driving hydraulic circuit for driving a working machine which is attached to the vehicle;

a working machine-driving hydraulic pump for discharging pressurized oil to the working machine-driving hydraulic circuit, said working machine-driving hydraulic pump being drivable by the engine;

a flow joining valve connected to the hydraulic travel circuit and the working machine-driving hydraulic circuit; and a controller for actuating said flow joining valve so as to join pressurized oil, discharged from the working machine-driving hydraulic pump, with pressurized oil in the hydraulic travel circuit when a pressure of the hydraulic travel circuit is lower than a first predetermined pressure and a speed of the engine is a predetermined speed value or higher.

2. A hydraulic circuit in accordance with claim 1, wherein said controller actuates said flow joining valve so that joining of pressurized oil, discharged from the working machine-driving hydraulic pump, with the pressurized oil in the hydraulic travel circuit is cut off when the pressure of the hydraulic travel circuit is higher than said first predetermined pressure.

3. A hydraulic circuit in accordance with claim 1, wherein said hydraulic travel pump is a variable displacement hydraulic travel pump; and wherein the hydraulic travel circuit is an open circuit comprising:

a tank, for storing oil;

said variable displacement hydraulic travel pump for sucking oil and for discharging pressurized oil;

a travel directional control valve for switching pressurized oil from the variable displacement hydraulic travel pump; and said hydraulic travel motor, which rotates clockwise or counterclockwise to produce an output upon receipt of switched pressurized oil from the travel directional control valve.

4. A hydraulic circuit in accordance with claim 1, further comprising a selector switch for switching between high-speed traveling and low-speed traveling; and wherein the flow joining valve is operated in association with an operation of the selector switch for switching between high-speed traveling and low-speed traveling.

* * * * *